US012035874B2

(12) United States Patent
Hotary et al.

(10) Patent No.: US 12,035,874 B2
(45) Date of Patent: Jul. 16, 2024

(54) EDGE CLEANING BRUSHES FOR FLOOR CLEANER

(71) Applicant: BISSELL Inc., Grand Rapids, MI (US)

(72) Inventors: James Theodore Hotary, Holland, MI (US); Chris J. Harmelink, Wyoming, MI (US); John Joseph Bleau, Plymouth, MI (US); Qian Yu Zhang, Dongguan (CN); Yongsheng Liang, Shenzhen (CN); Christopher L. Hogg, Holland, MI (US)

(73) Assignee: BISSELL Inc., Grand Rapids, MI (US)

( * ) Notice: Subject to any disclaimer, the term of this patent is extended or adjusted under 35 U.S.C. 154(b) by 272 days.

(21) Appl. No.: 17/676,313

(22) Filed: Feb. 21, 2022

(65) Prior Publication Data

US 2022/0175204 A1 Jun. 9, 2022

Related U.S. Application Data

(63) Continuation of application No. 17/207,807, filed on Mar. 22, 2021, now Pat. No. 11,284,759.

(60) Provisional application No. 63/001,573, filed on Mar. 30, 2020.

(51) Int. Cl.

| | |
|---|---|
| ***A47L 9/04*** | (2006.01) |
| ***A46B 9/00*** | (2006.01) |
| ***A46B 9/02*** | (2006.01) |
| ***A46B 13/00*** | (2006.01) |
| ***A46B 13/02*** | (2006.01) |

(Continued)

(52) U.S. Cl.

CPC ..... *A47L 9/0488* (2013.01); *A46B 9/005* (2013.01); *A46B 9/026* (2013.01); *A46B 13/005* (2013.01); *A46B 13/02* (2013.01); *A46D 1/0207* (2013.01); *A47L 5/30* (2013.01); *A47L 9/0411* (2013.01); *A47L 9/0433* (2013.01); *A47L 9/0444* (2013.01); *A47L 9/0472* (2013.01); *A47L 9/0477* (2013.01); *A46B 2200/3033* (2013.01)

(58) Field of Classification Search

CPC .... A47L 9/0488; A47L 9/0433; A47L 9/0444; A47L 9/0427; A47L 9/0405; A47L 9/0411; A47L 5/30; A47L 11/4069

See application file for complete search history.

(56) References Cited

U.S. PATENT DOCUMENTS

| | | | |
|---|---|---|---|
| 1,673,160 A | 6/1928 | Ross | |
| 4,032,239 A | 6/1977 | Maupin | |
| 4,709,439 A | 12/1987 | Warren et al. | |

(Continued)

FOREIGN PATENT DOCUMENTS

| | | | |
|---|---|---|---|
| DE | 19507683 | 9/1995 | |
| EP | 2749194 A2 * | 7/2014 | ..... A47L 9/0433 |

(Continued)

*Primary Examiner* — Bryan R Muller

(74) *Attorney, Agent, or Firm* — Warner Norcross + Judd LLP

(57) ABSTRACT

A surface cleaning apparatus can include a housing adapted to move across a surface to be cleaned, an edge brush, and a brushroll driven by a brush motor. The edge brush is connectable with a drive coupling for rotating the edge brush, and is indirectly driven by the brush motor via the brushroll. In one aspect, the edge brush and drive coupling comprise a modular unit removably coupled to the housing. In another aspect, the drive coupling can include a worm and a belt.

17 Claims, 16 Drawing Sheets

(51) Int. Cl.
*A46D 1/00* (2006.01)
*A47L 5/30* (2006.01)

(56) References Cited

U.S. PATENT DOCUMENTS

| | | | | |
|---|---|---|---|---|
| 4,739,534 | A | 4/1988 | Wilson | |
| 4,747,176 | A | 5/1988 | Parks | |
| 5,533,222 | A | 7/1996 | Lelkes et al. | |
| 7,328,477 | B1 | 2/2008 | Aiyar | |
| 7,908,701 | B1 | 3/2011 | Aiyar | |
| 9,414,734 | B2 * | 8/2016 | Moon | A47L 11/4069 |
| 2004/0006838 | A1 | 1/2004 | Ariznabarreta et al. | |
| 2006/0236491 | A1 | 10/2006 | Baek | |
| 2010/0107356 | A1 * | 5/2010 | Jakubos | A47L 9/0433 15/383 |
| 2012/0090133 | A1 | 4/2012 | Kim et al. | |
| 2013/0047368 | A1 | 2/2013 | Tran | |
| 2015/0223653 | A1 | 8/2015 | Kim et al. | |
| 2018/0098677 | A1 | 4/2018 | Paavola | |
| 2019/0216211 | A1 | 7/2019 | Swain et al. | |
| 2021/0169284 | A1 * | 6/2021 | Royale | A47L 9/322 |
| 2023/0147162 | A1 * | 5/2023 | Kim | A47L 9/2847 15/389 |

FOREIGN PATENT DOCUMENTS

| | | |
|---|---|---|
| EP | 2891444 | 7/2015 |
| EP | 2749194 | 11/2018 |

* cited by examiner

EDGE CLEANING BRUSHES FOR FLOOR CLEANER

CROSS-REFERENCE TO RELATED APPLICATION(S)

This application is a continuation of U.S. patent application Ser. No. 17/207,807, filed Mar. 22, 2021, which claims the benefit of U.S. Provisional Patent Application No. 63/001,573, filed Mar. 30, 2020, both of which are incorporated by reference herein in their entirety.

BACKGROUND

Floor cleaners include one or more cleaning implements for removing debris from the floor surface. For example, brushes are used to propel debris toward a suction nozzle or debris inlet. A side or edge cleaning brush may rotate about a substantially vertical axis and sweep debris under the floor cleaner for collection, and clean hard-to reach spaces such as along edges and in corners of a room, including edges or corners created by walls, baseboards, cabinetry, furniture, etc. Such edge cleaning brushes often have bristles that can fling debris outside the cleaning path of the floor cleaner, rather than collecting debris. Another problem with some edge cleaning brushes is that the drive system for rotating the edge cleaning brush limits where the edge cleaning brush can be placed on the floor cleaner.

BRIEF SUMMARY

In one aspect, the disclosure relates to an edge cleaning brush for a floor cleaner or surface cleaning apparatus.

In one embodiment, a surface cleaning apparatus includes a housing, a brush motor, a brushroll rotatable about a brushroll axis, wherein the brushroll is operably coupled to and driven the brush motor, and a modular unit removably coupled to the housing. The modular unit includes an edge brush having an attachment hub rotatable about a rotational axis and a cleaning implement configured to contact the surface to be cleaned, and an edge brush drive coupling to operably couple the edge brush with the brushroll. The brush drive coupling includes a gear train operably coupleable with the brushroll and a gear casing housing the gear train.

In another embodiment, a surface cleaning apparatus includes a housing, a brush motor, a brushroll rotatable about a brushroll axis, wherein the brushroll is operably coupled to and driven the brush motor, and an edge brush mounted on the housing, wherein the edge brush is operably coupled to and driven the brush motor. The edge brush includes an attachment hub rotatable about a rotational axis that is substantially perpendicular to the brushroll axis and a cleaning implement configured to contact the surface to be cleaned. A drive coupling between the attachment hub and the brushroll includes a worm operably coupled with brushroll for rotation therewith, a two-stage gear having a first gear enmeshed with the worm and a second gear coupled with the first gear for rotation therewith, and a belt coupled with the second gear to transmit the rotational force of the two-stage gear to a driven gear coupled with the attachment hub of the edge brush.

These and other features and advantages of the present disclosure will become apparent from the following description of particular embodiments, when viewed in accordance with the accompanying drawings and appended claims.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DETAILED DESCRIPTION

Figure 1:
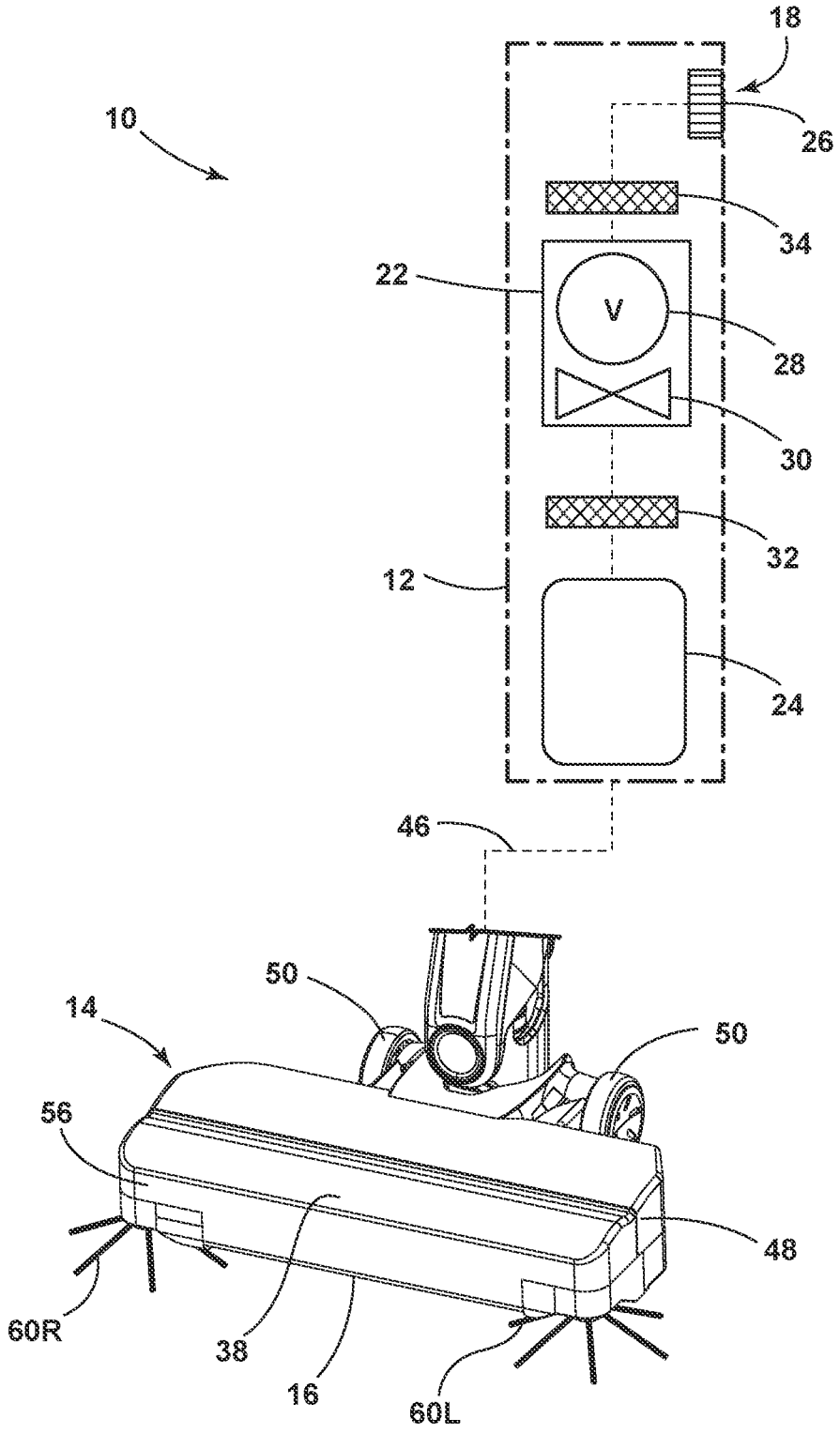
FIG. 1 is a schematic view of a floor cleaner including one or more edge cleaning brushes in accordance with various aspects described herein.

The disclosure generally relates to brushes for surface cleaning apparatus that clean floor surfaces, including bare floors such as hardwood, tile, and stone, and soft surfaces such as carpets and rugs. Various embodiments of an edge cleaning brush are described below. As will be appreciated from the description herein, the edge cleaning brush may have multiple applications, but is generally provided on a housing of a floor cleaner that is adapted to move over a surface to cleaned, the edge cleaning brush located on the housing in a position to clean hard-to reach spaces such as along edges and in corners of a room, including edges or corners created by walls, baseboards, cabinetry, furniture, etc. At least some embodiments of the edge cleaning brush provided herein with a tension element that applies downward force on a cleaning implement in contact with a surface to be cleaned. In another aspect, drive systems for edge cleaning brushes are described below.

The functional systems of the surface cleaning apparatus can be arranged into any desired configuration, such as an upright device having a base and an upright body for directing the base across the surface to be cleaned. Other configurations include a canister device having a cleaning tool connected to a wheeled base by a vacuum hose, a portable device adapted to be hand carried by a user for cleaning relatively small areas, an autonomous or robotic device, or a commercial device. Any of the aforementioned cleaners can be adapted to include a flexible vacuum hose, which can form a portion of the working air conduit between a nozzle and the suction source. Any of the aforementioned cleaners can be adapted for cordless or corded operation, optionally including an on-board battery for cordless operation.

In one embodiment, the surface cleaning apparatus can be a vacuum cleaner including at least a vacuum collection system for creating a partial vacuum to suck up debris from a floor surface and collect the removed debris in a space provided on the apparatus for later disposal. The term "debris" encompasses dirt, dust, soil, hair, stains, and other debris, unless otherwise noted.

In another embodiment, the surface cleaning apparatus can be a sweeper including a sweeping system for removing dry debris from the surface to be cleaned, without the use of suction, and collect the removed debris in a space provided on the apparatus for later disposal.

In yet another embodiment, the surface cleaning apparatus can be an extraction cleaner or deep cleaner, and can include a fluid delivery system for storing cleaning fluid and delivering the cleaning fluid to the surface to be cleaned and a fluid recovery system for removing the cleaning fluid and debris from the surface to be cleaned and storing the recovered cleaning fluid and debris. The fluid delivery system may be configured to delivery liquid, steam, mist, or vapor to the surface to be cleaned.

In still another embodiment, the surface cleaning apparatus can be a wet mopping or sweeping apparatus, including a fluid delivery system for storing cleaning fluid and delivering the cleaning fluid to the surface to be cleaned and a mopping or sweeping system for removing cleaning fluid and debris from the surface to be cleaned without the use of suction. The fluid delivery system may be configured to delivery liquid, steam, mist, or vapor to the surface to be cleaned.

FIG. 1 is a perspective view of a portion of a surface cleaning apparatus according to one aspect of the present disclosure, shown as an upright floor cleaning apparatus, and more specifically an upright vacuum cleaner, and generally designated 10. As discussed in further detail below, the vacuum cleaner 10 is provided with various features and improvements, including at least one edge cleaning brush 60, described in further detail below. The at least one edge cleaning brush 60 can clean hard-to reach spaces such as along edges and in corners of a room, including edges or corners created by walls, baseboards, cabinetry, furniture, etc. As illustrated herein, the vacuum cleaner 10 has a housing that includes an upright handle assembly or body 12 and a cleaning foot or base 14 mounted to or coupled with the upright body 12 and adapted for movement across a surface to be cleaned. The vacuum cleaner 10 includes a vacuum collection system, which is described in further detail below, and which can include components supported on either one or both of the body 12 and base 14.

For purposes of description related to the figures, the terms "upper," "lower," "right," "left," "rear," "front," "vertical," "horizontal," "inner," "outer," and derivatives thereof shall relate to the disclosure as oriented in FIG. 1 from the perspective of a user behind the vacuum cleaner 10, which defines the rear of the vacuum cleaner 10. However, it is to be understood that the disclosure may assume various alternative orientations, except where expressly specified to the contrary.

The upright body 12 can comprise any type of elongated handle or body suitable for the purposes described herein and can comprise a handle or be otherwise configured for a user to maneuver the vacuum cleaner 10 over a surface to be cleaned. The upright body 12 can be adapted to pivot about one or more axes through a range of angles relative to the surface to be cleaned. Optionally, the upright body 12 can be configured so as to swivel about its longitudinal axis in addition to pivoting relative to the base 14.

Figure 2:
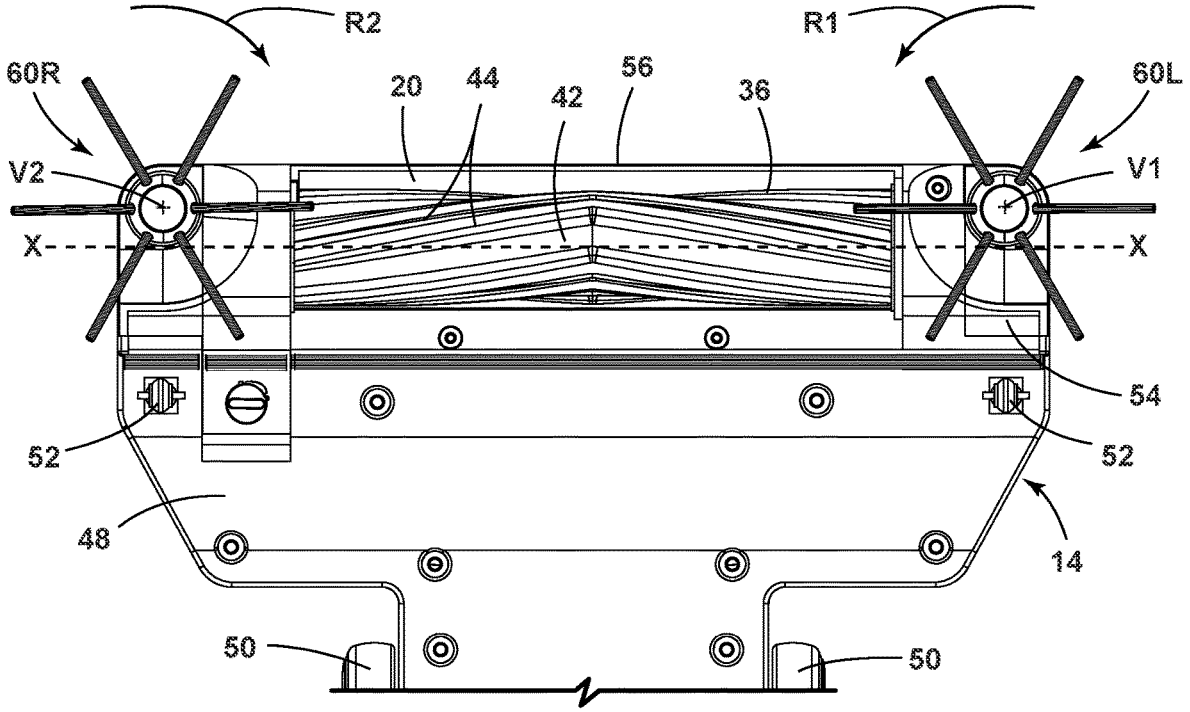
FIG. 2 is a bottom view of a base of the floor cleaner from FIG. 1.

With additional reference to FIG. 2, the vacuum collection system can include a working air path or recovery pathway through the housing, including one or both of the body 12 and base 14. The recovery pathway can include at least a dirty inlet 16 and a clean air outlet 18. The pathway can be formed by, among other elements, a suction nozzle 20 defining the dirty inlet, a suction source 22 in fluid communication with the suction nozzle 20 for generating a working air stream, a debris collector 24 for collecting debris from the working airstream for later disposal, and at least one exhaust vent 26 defining the clean air outlet 18.

The suction source 22, which can be a motor/fan assembly including a vacuum motor 28 and a fan 30, is provided in fluid communication with the collector 24. The motor/fan assembly 22 can be fluidly upstream of the air outlet, and can define a portion of the working air path. The motor/fan assembly 22 can be positioned downstream of the collector 24 in the recovery pathway. In other embodiments, the motor/fan assembly 22 may be located fluidly upstream of the collector 24.

The collector 24 can also define a portion of the working air path and can comprise a separator (not shown) for separating debris from the working airstream. Some non-limiting examples of the separator include at least one cyclonic or centrifugal separator, filter screen, foam filter, HEPA filter, flexible and air-permeable filter bag, or combinations thereof.

The collection system can also be provided with one or more additional filters upstream or downstream of the suction source 22. For example, in the illustrated embodiment, a pre-motor filter 32 is provided in the recovery pathway downstream of the collector and upstream of the suction source 22. A post-motor filter 34 can be provided in the recovery pathway downstream of the suction source 22 and upstream of the clean air outlet 18. The collection system can further include various conduits, ducts, or tubes for fluid communication between the various components of the vacuum collection system.

Referring to FIG. 2, the suction nozzle 20 can be provided on the base 14 can be adapted to be adjacent the surface to be cleaned as the base 14 moves across a surface. A brushroll 36 or other agitator can be provided adjacent to the suction nozzle 20 for agitating the surface to be cleaned so that the debris is more easily ingested into the suction nozzle 20. The suction nozzle 20 shown herein is positioned to confront the surface to be cleaned to remove debris from the surface. In other embodiments, the suction nozzle 20 can be positioned in close proximity to the brushroll 36 to collect debris directly from the brushroll 36.

In the 60L, 60R embodiment shown herein, the suction nozzle 20 is provided between two edge cleaning brushes 60L, 60R. In other embodiments, the suction nozzle 20 can be provided to the rear of the edge cleaning brushes 60L, 60R. In either case, the edge cleaning brushes 60L, 60R can sweep debris under the base 14 and toward the suction nozzle 20.

The vacuum cleaner 10 can include a brush chamber 38 in which the brushroll 36 is mounted. The brushroll 36 is mounted for rotation about a substantially horizontal axis X, relative to the surface over which the base 14 moves. The suction nozzle 20 can be formed at a lower side of the brush chamber 38. The edge cleaning brushes 60L, 60R can be located outwardly of the lateral sides or ends of the brush chamber 38

In the present example, brushroll 36 can be a bristleless brushroll or roller. The brushroll 36 shown in FIG. 2 comprises a core 42 and a plurality of chevron vanes 44 extending from the core 42, although a variety of different vane shapes can be used. The vanes 44 can be integrally formed with the core 42, such as through injection molding, additive manufacturing, or another suitable process. The core 42 and vanes 44 can be constructed of a polymeric material such as acrylonitrile butadiene styrene (ABS), polypropylene or styrene, or any other suitable material such as plastic, wood, or metal.

Other embodiments of the brushroll 36 are possible. For example, the brushroll 36 can comprise tufted bristles or a soft and compressible material, such as microfiber. In still other embodiments, the brushroll 36 can comprise nylon fiber, foam, elastomeric blades and paddles. Additionally, while a single horizontally-rotating brushroll 36 is shown herein, in some embodiments, dual horizontally-rotating brushrolls can be provided on the vacuum cleaner 10.

In another embodiment, the brushroll 36 can be a hybrid brushroll suitable for use on both hard and soft surfaces, and for wet or dry vacuum cleaning. Such a hybrid brushroll can include a combination of bristles and microfiber. One example of a suitable hybrid brushroll is disclosed in U.S. Pat. No. 10,092,155, issued Oct. 9, 2018, which is incorporated herein by reference in its entirety.

The suction nozzle 20 can be in fluid communication with the collector 24 through a conduit 46. In embodiments where the collector 24 is located on the upright body 12, the conduit 46 can pass through the joint assembly between the base 14 and upright body 12, and can be flexible to accommodate the movement of the upright body 12 relative to the base 14.

The base 14 can include a base housing 48 supporting at least some of the components of the collection system, such as the brushroll 36 and edge cleaning brushes 60L, 60R in the embodiment shown herein. A pair of wheels 50 can be attached to the base housing 48 for moving the vacuum cleaner 10 over the surface to be cleaned. The wheels 50 can be provided on rearward portion of the base housing 48, rearward of components such as the suction nozzle 20, the brushroll 36, the edge cleaning brushes 60L, 60R, or any combination thereof. A second pair of wheels 52 can be attached to the base housing 48, forward of the first pair of wheels 50.

The vacuum cleaner 10 shown includes two edge cleaning brushes 60L, 60R on the underside 54 of the base 14, for example on an underside of the base housing 48. The edge cleaning brushes 60L, 60R are mounted for rotation about a substantially vertical rotational axis V1, V2 respectively, relative to the surface over which the base 14 moves. In being substantially vertical, the rotational axis V1, V2 can deviate up to 5 degrees from vertical, up to 10 degrees from vertical, up to 20 degrees from vertical, or up to 45 degrees from vertical. In some embodiments, the rotational axis V1, V2 is configured to maximize the contact area between the edge cleaning brush 60L, 60R and the surface to be cleaned. In the present embodiment, two edge cleaning brushes 60L, 60R are provided, and arranged at opposite lateral sides, i.e. left and right sides, of the base 14 so that the vacuum cleaner 10 can edge clean on either side of the base 14 without changing the orientation of the base 14. In other embodiments, only one edge cleaning brush 60 is provided.

Figure 3:
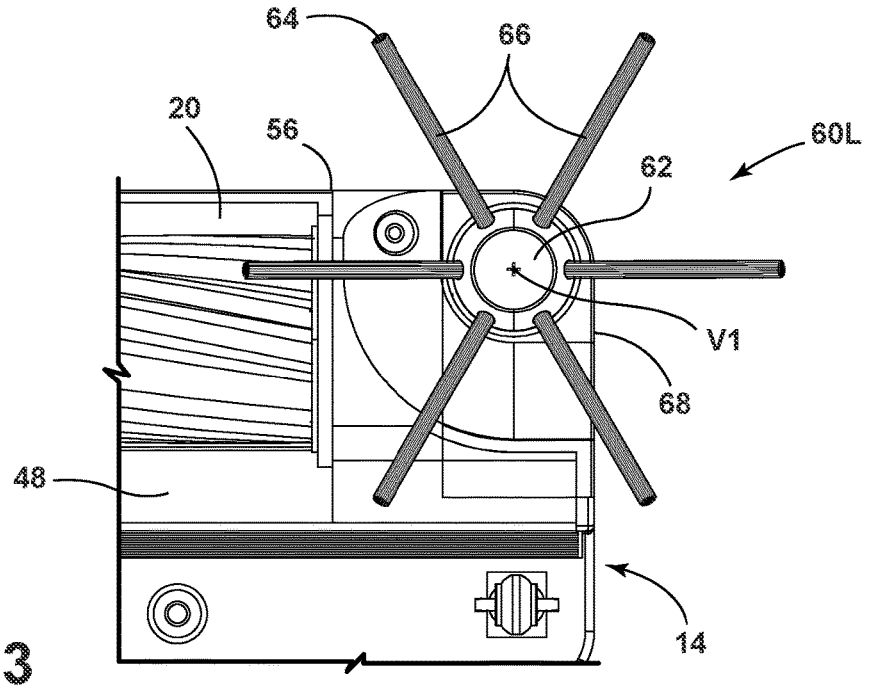
FIG. 3 is an enlarged view of a portion of FIG. 2, illustrating an edge cleaning brush on the bottom of the base.

Advantageously, the edge cleaning brushes 60L, 60R sweep debris under the base 14 and toward the suction nozzle 20. The direction of rotation for each edge cleaning brush 60L, 60R is indicated in FIG. 3 by arrows R1 and R2. As is illustrated in FIG. 2, the edge cleaning brushes 60L, 60R can counter-rotate such that debris is swept towards the suction nozzle 20 by both brushes 60L, 60R, and the suction source 22 can transport the debris to the collector 24. The left side edge cleaning brush 60L rotates in a clockwise direction R1 as viewed from bottom. The right side edge cleaning brush 60R rotates in a counterclockwise direction R2 as viewed from bottom. In one example, at least a portion of the edge cleaning brushes 60L, 60R 60 extend beyond a periphery of the base housing 48 such that debris adjacent the base 14 of the vacuum cleaner 10 can be swept toward the suction nozzle 20. In the embodiment shown herein, the edge cleaning brushes 60L, 60R are mounted at a forward or leading end 56 of the base 14, forwardly of the suction nozzle 20, and sweep debris toward the center and rear of the base 14, i.e. toward the suction nozzle 20. The edge cleaning brushes 60L, 60R are also mounted forwardly of the axis X of the brushroll 36, and sweep debris toward the brushroll 36 which can aid in collecting the debris. In other embodiments, the edge cleaning brushes 60L, 60R can be mounted at another location on the base 14, along only the left side of the base 14, or along only the right side of the base 14.

In other embodiments of the apparatus 10, the collection system can be configured as a sweeping or mechanical collection system that mechanically collects debris and liquid without the use of suction, such as by the action of the brushroll 36 and edge cleaning brushes 60L, 60R mechanically propelling debris directly into the collector 24. In such an embodiment, the edge cleaning brushes 60L, 60R can sweep debris under the base 14 and toward a debris inlet on the base 14.

In yet another alternative or additional collection mechanism, the apparatus 10 can include a mopping or dusting assembly for removing moistened debris from the surface to be cleaned. Such a mopping or dusting assembly can optionally include at least one mopping or dusting pad and one or more edge cleaning brushes 60L, 60R that can sweep debris under the base 14 and toward the pad. The pad can be stationary or rotatable.

The edge cleaning brush 60L, 60R may comprise one or more different agitation or cleaning implements configured to brush, sweep, dust, mop, or otherwise move debris on the surface to be cleaned. Some non-limiting examples of cleaning implements for the edge cleaning brush 60L, 60R comprise blades, bristles, paddles, blades, flaps, microfiber material, fabric, dusting pads, and the like.

The embodiment of the edge cleaning brush 60L shown in FIG. 3 includes a rotational body 62 configured to rotate with respect to the base housing 48 and a cleaning implement 64 coupled with the rotational body 62 for rotation therewith. By being "coupled with" the rotational body 62, the cleaning implement 64 can be attached to, formed with, or otherwise suitably joined to the rotational body 62 for rotation therewith. The cleaning implement 64 can be configured to brush, sweep, dust, mop, or otherwise move debris on the surface to be cleaned. As discussed above, the cleaning implement 64 can move debris on the surface to be cleaned toward the suction nozzle 20 or other debris inlet on the housing 48.

The cleaning implement 64 can comprise a plurality of bristle sets 66, each bristle set 66 comprising a plurality of bristles. The bristles can be constructed of nylon, polybutylene terephthalate (PBT), or any other suitable synthetic or natural fiber. The bristle sets 66 can project radially from the rotational body 62 as shown, or can project tangentially or at another angle in other embodiments.

Portions of the cleaning implement 64 can project beyond the forward or leading end 56 of the base 14 and/or can project beyond a lateral side 68 of the base 14. For example, distal ends of some of the bristle sets 66 can extend outside the base housing 48 as shown in FIG. 3, including forwardly and laterally of the base housing 48.

The length of the bristle sets 66 can be equal to each other as shown, or bristle sets of different lengths can be provided. It is also noted that the bristles in each set 66 are shown as having the same length, however in other embodiments of the edge cleaning brush 60L, the length of individual bristles within one set 66 may vary.

The bristle sets 66 can be spaced equally about the rotational axis V1. For example, in the embodiment of the edge cleaning brush 60L shown, the cleaning implement 64 can comprise six bristle sets 66 which are spaced approximately 60° from each other. Other bristle set numbers and spacing are possible, such as, but not limited to, nine bristle sets 66 which are spaced approximately 40° from each other. In yet another embodiment, rather than being arranged in discrete sets, bristles can be arranged substantially continuously about the rotational body 62.

The rotational body 62 can comprise a hub configured to rotate on the rotational axis V1. Optionally, the rotational body 62 can comprise a peripheral surface that is disposed radially outwardly from the rotational axis V1, and the bristle sets 66 can project radially with respect to the peripheral surface. In other embodiments, the bristle sets 66 can project tangentially or at another angle from the peripheral surface.

Figure 4:
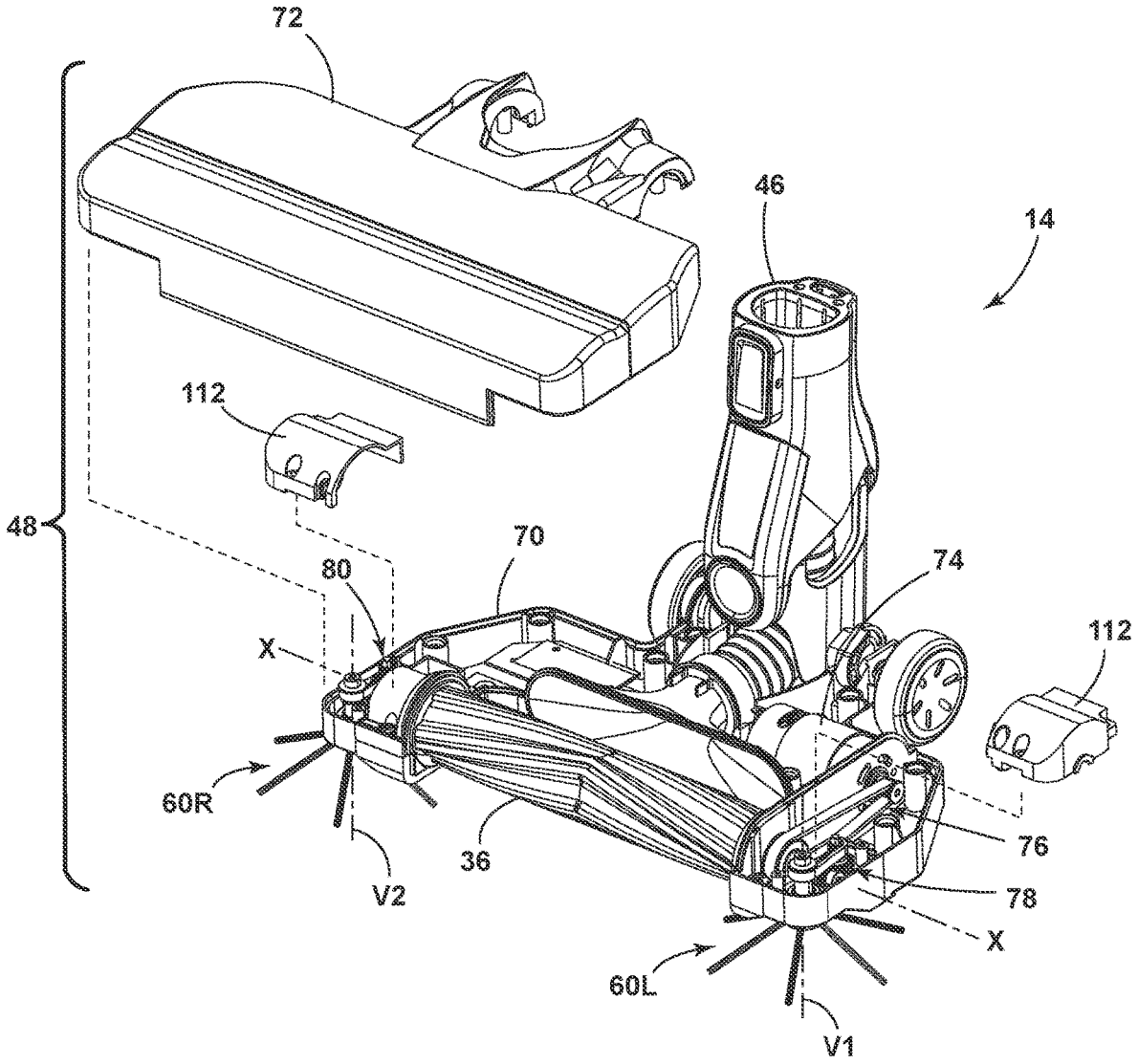
FIG. 4 is a perspective view of the base, with a top cover of the base and upper gear covers for drive couplings of the edge cleaning brushes exploded to show internal components of the base.

Referring to FIG. 4, the base housing 48 can be made up of one or more separate pieces, casings, or housings. In one non-limiting example, the base housing 48 can include at least a lower cover 70 and an upper cover 72 enclosing components of the base 14 therebetween. The upper cover 72 is shown exploded from the lower cover 70 in FIG. 4.

In one embodiment, the brushroll 36 and both edge cleaning brushes 60L, 60R can be operably coupled to and driven by a drive assembly including a brushroll motor or brush motor 74 in the base 14. Alternatively, the vacuum motor 28 (FIG. 3) can provide both vacuum suction and rotate one or more of the brushes 36, 60L, 60R. In another alternate embodiment, a motor (not shown) separate from the brush motor 74 can be provided in the base 14 for driving the edge cleaning brushes 60L, 60R, with both edge cleaning brushes 60L, 60R operably coupled to and driven by the common, separate motor. In yet another alternate embodiment, individual motors (not shown) separate from the brush motor 74 can be provided in the base 15 for driving each of the edge cleaning brushes 60L, 60R, with each edge cleaning brush 60L, 60R operably coupled to and driven by one of the individual, separate motor.

In the embodiment shown, the brush motor 74 is configured to drive the brushroll 36 about rotational axis X, the first or left-side edge cleaning brush 60L about rotational axis V1, and the second or right-side edge cleaning brush 60R about rotational axis V2. Drive couplings or transmissions couple the brush motor 74 to each of the brushes 36, 60L, 60R. Each drive coupling can comprise one or more belts, gears, shafts, pulleys or combinations thereof.

The rotational axes V1, V2 of the edge cleaning brushes 60L, 60R can be disposed at opposing ends of the brushroll 36. In the embodiment shown, the rotational axes V1, V2 of the edge cleaning brushes 60L, 60R are spaced from each end of the brushroll 36. As shown in bottom view of FIG. 2, the rotational axes V1, V2 of the edge cleaning brushes 60L, 60R can disposed forwardly of the rotational axis X. In other embodiments, the rotational axes V1, V2 can intersect the rotational axis X.

The rotational axes V1, V2 of the edge cleaning brushes 60L, 60R can be substantially perpendicular to the rotational axis X of the brushroll 36. In being substantially perpendicular, the rotational axes V1, V2 can deviate up to 5 degrees from perpendicular, up to 10 degrees from perpendicular, or up to 20 degrees from perpendicular. The rotational axes V1, V2 of the edge cleaning brushes 60L, 60R can be parallel to each other, or non-parallel.

In the embodiment shown in FIG. 4, the brushroll 36 is operably coupled to and driven by a drive assembly including the brush motor 74 and a drive coupling or transmission 76 between the brushroll 36 and the brush motor 74. The first edge cleaning brush 60L is operably coupled to and driven by a drive assembly including the brush motor 74 and a drive coupling or transmission 78 between the brush 60L and the brushroll 36. The second edge cleaning brush 60R is operably coupled to and driven by a drive assembly including the brush motor 74 and a drive coupling or transmission 80 between the brush 60R and the brushroll 36.

The edge brush drive couplings 78, 80 for each edge cleaning brush 60R, 60L can be configured to reduce the drive speed of the brushes 60R, 60L, such that the edge cleaning brushes 60R, 60L move at slower speeds than the brushroll 36. If not reduced, the edge cleaning brushes 60R, 60L may fling debris away from the base 14 instead of sweeping debris toward the suction nozzle 20. In one example, the brushroll 36 is driven at 3000-4375 rpm, inclusive, alternatively at 3100-3700 rpm, inclusive, and the edge cleaning brushes 60R, 60L are driven at 110 rpm, alternatively at 135 rpm, alternatively at 120-140 rpm, inclusive, alternatively at 150-175 rpm, inclusive.

Figure 5:
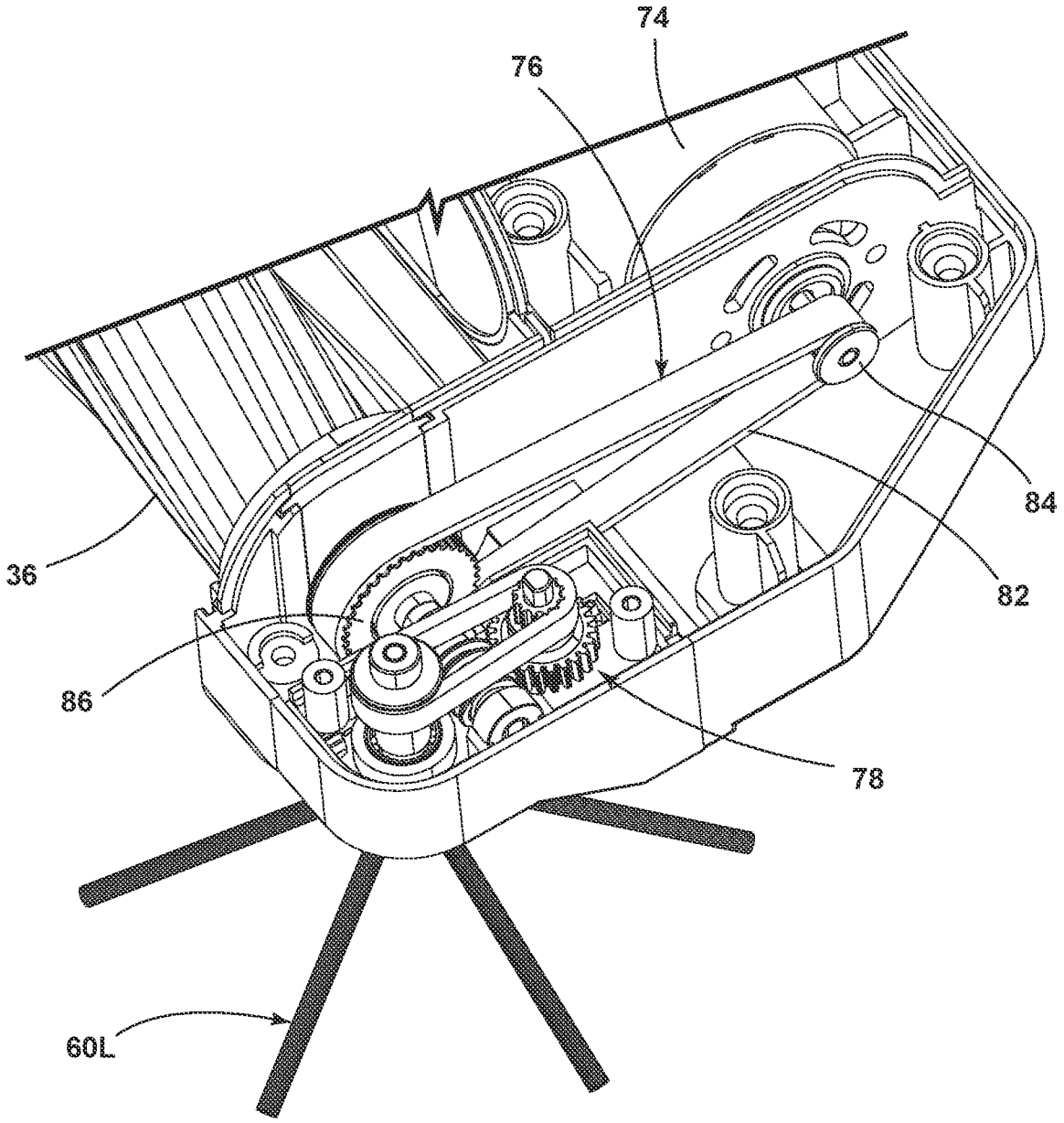
FIG. 5 is an enlarged perspective view of a portion of the base, with the top cover and upper gear cover removed to show a brushroll drive coupling and an edge cleaning brush drive coupling.
Figure 6:
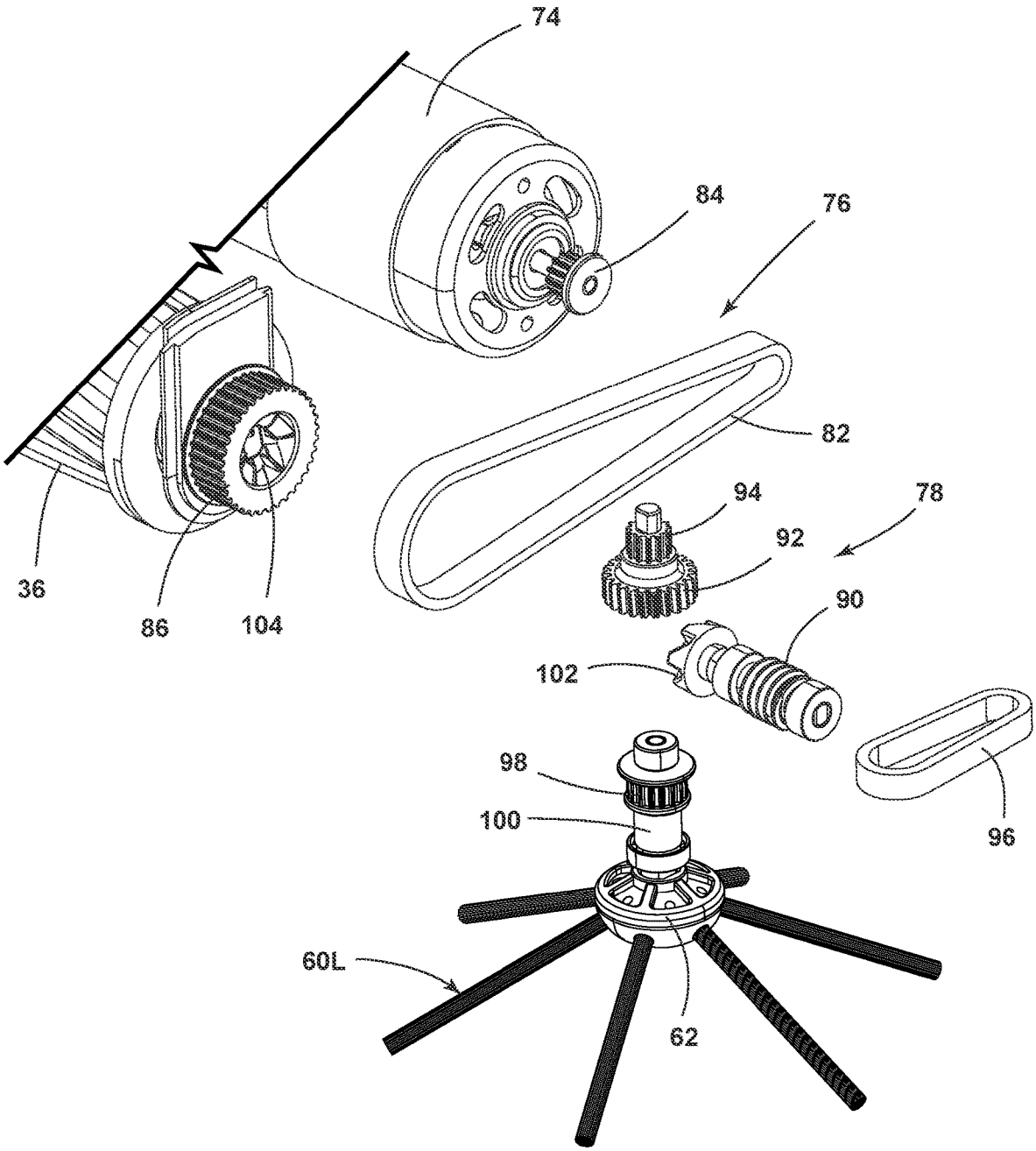
FIG. 6 is an exploded view of the brushroll drive coupling and edge cleaning brush drive coupling from FIG. 5.

Referring to FIGS. 5-6, in one embodiment the brushroll drive coupling 76 can include a drive belt 82 frictionally engaging a drive wheel 84 coupled with an output of the brush motor 74 and a driven wheel 86 on the brushroll 36, and which transmits the rotational force provided by the motor 28 to the brushroll 36.

The edge brush drive coupling 78 can include a gear train having an input gear coupled with the brushroll 36 or with the transmission between the brushroll 36 and the brush motor 74. In the embodiment shown in FIG. 5-6, the gear train for the first edge cleaning brush 60L includes a worm 90 operably coupled with brushroll 36 for rotation therewith, a two-stage driven gear having a first or worm gear 92 enmeshed with the worm 90 and a second gear 94 coupled with the first gear 92 for rotation therewith, an edge brush belt 96 coupled with the second gear 94 to transmit the rotational force of the two-stage gear to a driven gear 98. The driven gear 98 is coupled with the edge cleaning brush 60L to drive the brush 60L for rotation about the axis V1.

The driven gear 98 can be coupled with a drive shaft 100 of the edge cleaning brush 60L. The driven gear 98 outputs a driving force to the drive shaft 100 and rotates at a predetermined speed. The drive shaft 100 can define the axis of rotation V1 of the edge cleaning brush 60L. Optionally drive shaft 100 can be joined with or otherwise coupled to the rotational body 62 (FIG. 3) of the edge cleaning brush 60L. The edge cleaning brush 60L can be fixedly or removably mounted to the drive shaft 100. With a removable mounting, the edge cleaning brush 60L can be an aftermarket or replacement component for existing edge cleaning brushes on vacuum cleaners and other floor cleaning devices.

The gear train described with respect to FIGS. 5-6 can reduce rotational speed of the edge cleaning brush 60L relative to the brushroll. In one embodiment, the gear reduction ratio from the worm 90 to the driven gear 98 can be 1:30.

The gear train can be coupled with the driven wheel 86 of the brushroll 36 for driving the worm gear 90. In the embodiment shown in FIG. 6, a splined driven member 102 is coupled with the worm 90, and the driven wheel 86 of the brushroll 36 can comprise a splined drive member 104 configured to mate axially with the splined driven member 102. The splined members 102, 104 have teeth, wedges, or other shaped members that enmesh when the splined members 102, 104 are axially engaged. The splined members 102, 104 thus form a splined connection between the worm 90 and driven wheel 86 to transfer torque to the worm 90. Other couplings between the brushroll 36 and gear train are possible.

The gear train configuration described with respect to FIGS. 5-6 can save space at the front side of the base 14, allowing the rotational axis V1 of the edge cleaning brush 60L to be closer to the forward end 56 of the base 14. Rather than directly driving the brush 60L via the worm gear 90, the use of the belt 96 to indirectly drive the brush 60L via the worm gear 90 allows the rotational axis V1 to be disposed farther from the brushroll rotational axis X. In an alternate embodiment, the worm 90 be coupled directly with the driven gear 98 attached to the drive shaft 100, with the belt 96 and other gears 92, 94 not provided.

The edge brush drive coupling 80 for the other edge cleaning brush 60R can be substantially similar, save for that the gear train can be coupled with a splined drive member 114 at the non-driven end of the brushroll 36 for driving the worm gear 90. In the embodiment shown in FIG. 9, the splined drive member 102 coupled with the worm 90 can enmesh with the splined drive member 114 to transfer torque to the worm 90. Other couplings between the brushroll 36 and gear train are possible.

Figure 7:
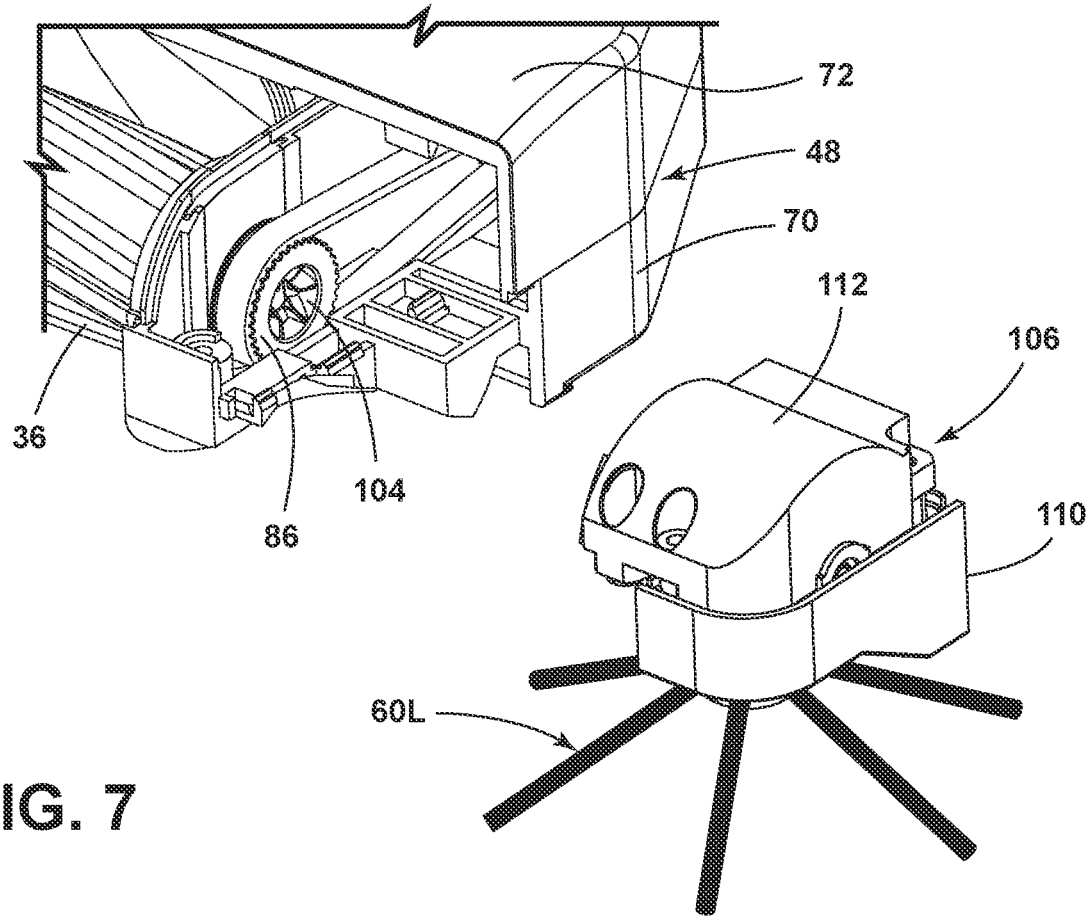
FIG. 7 is an exploded view illustrating a modular unit comprising the edge cleaning brush drive coupling from FIG. 6 and the edge cleaning brush.

With additional reference to FIG. 7, the edge brush drive coupling 78 can be housed within the base housing 48 or can be housed within a separate gear casing 106 that is formed with or otherwise coupled to the housing 48. To improve noise and vibration, the gear train of the drive coupling 78 can be located in a gear casing 106 as a module with more precise tolerance. The gear casing 106 can include an aperture 108 through which the drive shaft 100 extends to connect the drive coupling 78 with the edge cleaning brush 60. The gearbox for the edge cleaning brush 60L, i.e. the gear drive coupling 78 and its casing 106, can be disposed internal or external to the base housing 48, and may be removable from the base 14. With a non-removable gearbox, a portion of the edge cleaning brush 60L, such as its cleaning implement, can fixedly or removably mounted to the drive shaft 100.

The gear casing 106 can be made up of one or more separate pieces, casings, or housings. In one non-limiting example, the gear casing 106 can include at least a lower gear housing 110 and an upper gear cover 112 enclosing components of the edge brush drive coupling 78 therebetween. Gear upper cover 112 is shown exploded from the gear housing 110 in FIG. 7.

Figure 8:
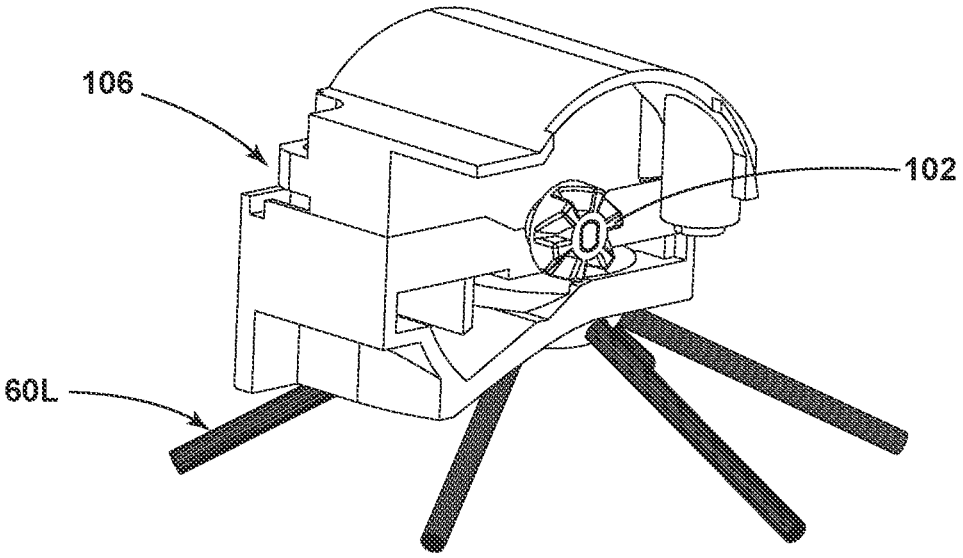
FIG. 8 is a rear perspective view showing the modular unit of FIG. 7.

In one embodiment, a modular unit comprising the edge brush drive coupling 78, gear casing 106, and optionally also comprising the edge cleaning brush 60L, is removably mounted to the base 14. With the modular unit shown in FIGS. 7-8, the edge brush drive coupling 78 and the edge cleaning brush 60L are simultaneously mountable to the base 14 by attachment of the gear casing 106 to the base 14 for easy assembly with the vacuum cleaner 10. Likewise, the edge brush drive coupling 78 and the edge cleaning brush 60L are simultaneously removable from the base 14 by removal of the gear casing 106 to the base 14, allowing for cleaning, repair, or replacement of the modular unit or components of the modular unit. With a modular unit or gearbox, the edge cleaning brush 60L can be an aftermarket or replacement component for existing edge cleaning brushes on vacuum cleaners and other floor cleaning devices. While the modular unit is shown as comprising the edge brush drive coupling 78 described with respect to FIGS. 5-6, it is understood that other edge brush transmissions are possible.

To assemble the modular unit or gearbox with the base 14, the gear casing 106 can be assembled with the lower cover 70, with the splined members 102, 104 enmeshing to couple the drive coupling 78 with the driven wheel 86 of the brushroll 36. The gear casing 106 can be attached to the lower cover 70 using any suitable attachment method, such as be using screws or other fasteners to mount the gear casing 106 on the lower cover 70. After securement of the gear casing 106, the top cover 72 (FIG. 4) can be mounted on the lower cover 70. The top cover 72 can cover at least a portion of the gear casing 106, as shown in FIG. 1.

Figure 9:
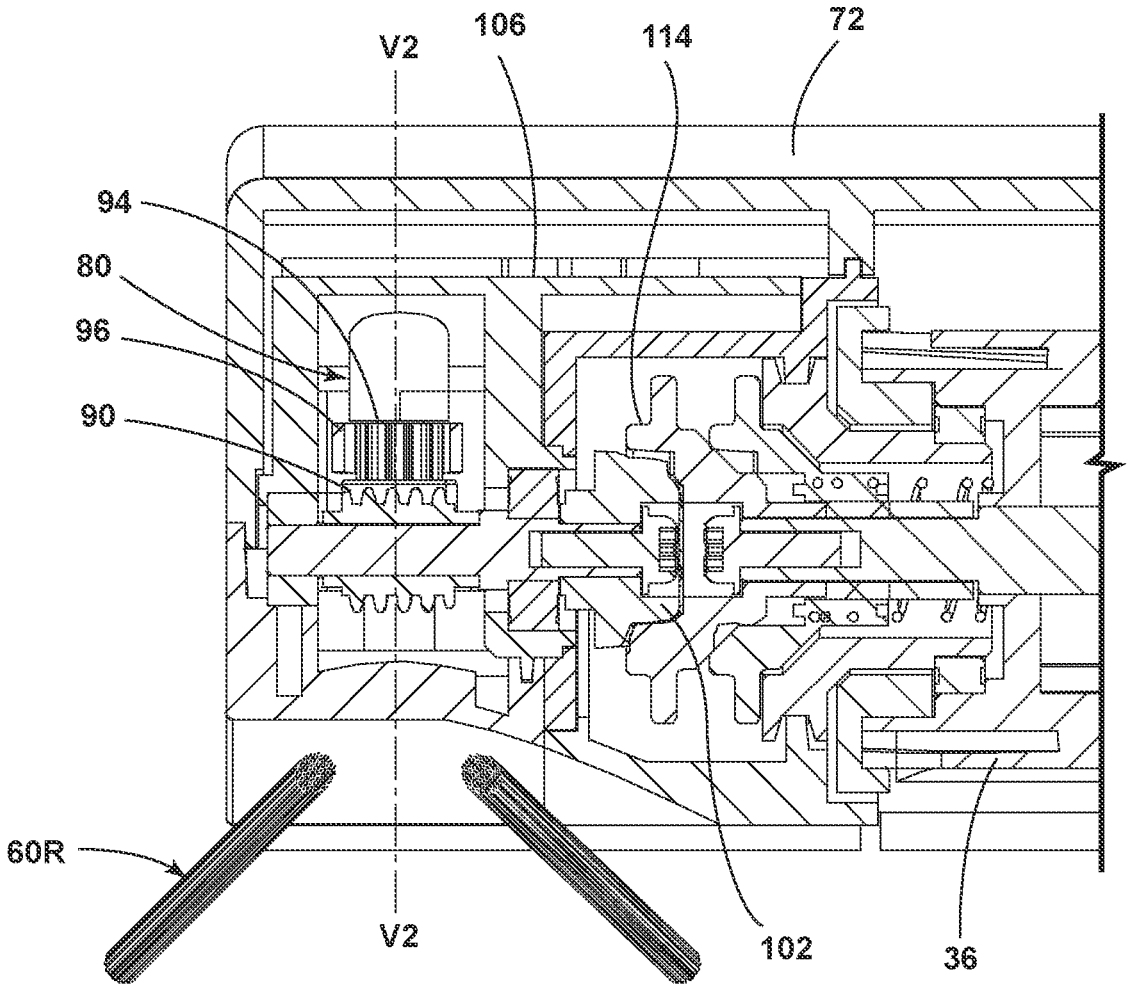
FIG. 9 is a sectional view taken through line IX-IX of FIG. XX, illustrating another edge cleaning brush drivingly connected with the brushroll.

A similar gear casing 106 for the right-side edge brush drive coupling 80 can be provided, as shown in FIGS. 4 and 9. The brushroll 36 and brush chamber 38 can be disposed in between the two gear casings 106. The top cover 72 can cover at least a portion of both gear casings 106, when installed on the lower cover 70.

FIGS. 10-15 show details of another embodiment of an edge cleaning brush, generally designated 160. The edge cleaning brush 160 can be provided on the vacuum cleaner 10 shown in FIGS. 1-9 in place of one or both of the edge cleaning brushes 60L, 60R, or can be provided on another surface cleaning apparatus to clean hard-to reach spaces such as along edges and in corners of a room, including edges or corners created by walls, baseboards, cabinetry, furniture, etc. The edge cleaning brush 160 can be configured rotate about a substantially vertical rotational axis V.

The edge cleaning brush 160 can include a rotational body 162 configured to rotate with respect to the base housing 48 (FIG. 1), or other floor cleaner housing, and a cleaning implement 164 coupled with the rotational body 162 for rotation therewith. By being "coupled with" the rotational body 162, the cleaning implement 164 can be attached to, formed with, or otherwise suitably joined to the rotational body 162 for rotation therewith. The cleaning implement 164 can be configured to brush, sweep, dust, mop, or otherwise move debris on the surface to be cleaned. As discussed above, the cleaning implement 164 can move debris on the surface to be cleaned toward the suction nozzle 20 (FIG. 2) or other debris inlet on a floor cleaner.

The edge cleaning brush 160 can include a tension element, such as a tensioner hub 166 that applies downward force F (see FIG. 11) on the cleaning implement 164 to force the cleaning implement 164 against a surface S to be cleaned. The tensioner hub 166 also provides structural support, allowing the cleaning implement 164 to be fabricated from materials and/or in shapes that may otherwise be too flexible or flimsy to effectively move debris on the surface to be cleaned toward the suction nozzle 20 (FIG. 2) or other debris inlet.

The tensioner hub 166 can be interposed between the rotational body 162 and the cleaning implement 164. The tensioner hub 166 can be assembled with the cleaning implement 164 to form a subassembly, and the rotational body 162 is subsequently assembled to the subassembly. For example, in one embodiment the tensioner hub is glued to the cleaning implement 164. In another embodiment the tensioner hub 166 can be integrally formed with the rotational body 162 to form a subassembly, and then subsequently affixed to the cleaning implement 164, such as by adhesive bonding, heat-staking, or overmolding, for example. In yet another embodiment the tensioner hub 166 can be overmolded on the cleaning implement 164 to form a subassembly, and the rotational body 162 is subsequently assembled to the subassembly.

The rotational body 162 can comprise an attachment hub 168 configured to rotate on rotational axis V. Optionally, the rotational body 162 can comprise a peripheral surface 170 that is disposed radially outwardly from the rotational axis V, and the cleaning implement 164 can project radially with respect to the peripheral surface 170.

The rotational body 162 can be coupled with a drive shaft, such as drive shaft 100 (FIG. 6) for rotation of the edge cleaning brush 160. The attachment hub 168 can have an opening 172 for receiving an end of the drive shaft 100. It is noted that the drive assembly of FIGS. 5-6 is but one example of a drive assembly for the edge cleaning brush 160, and that other drive assemblies can be used.

Figure 12:
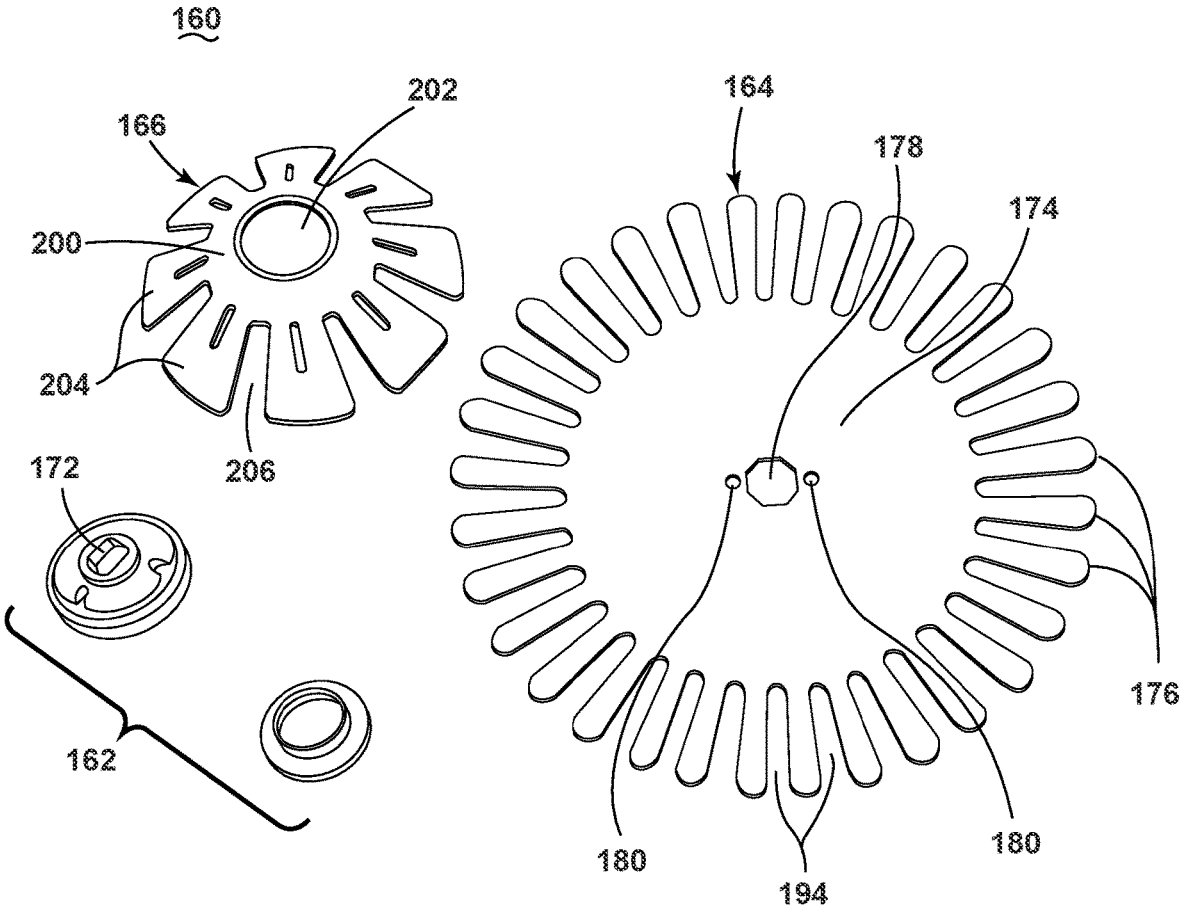
FIG. 12 is an exploded view of the edge cleaning brush from FIG. 10.

The attachment hub 168 can comprise a two-piece design as shown in FIG. 12, in which the inwardly-facing sides of the two-piece attachment hub 168 are shown. The two pieces can be separately molded from plastic, and then assembled together prior to assembly with the rest of the brush 160. For example, the two pieces of the hub 168 can be snapped together using a snap fit on either piece of the hub 168, Alternatively, the attachment hub 168 can comprise a one-piece design that is overmolded on the tension hub 166 and/or the cleaning implement 164.

The cleaning implement 164 can comprise a pad with an inner or center portion 174 and an outer portion comprising a plurality of fingers 176 that project from a periphery of the center portion 174. The pad can be fabricated by die cutting or another suitable manufacturing method, such that the center portion 174 and fingers 176 are cut from a single piece of flat material. In other embodiments, the pad can comprise multiple pieces attached, sewn, or otherwise joined together.

The cleaning implement 164 can be fabricated from microfiber fabric having fibers finer than one denier and/or having a diameter of less than ten micrometers (μm). The microfiber fabric can be made from polyesters, polyamides (e.g., nylon), or a combination of the two. In a specific embodiment, the microfiber fabric can be a microsuede fabric, a synthetic polyester fabric comprised of millions of microfibers. Microsuede can provide superior dust pick-up when compared to a conventional brush with bristles, particularly for fine debris, such as dust and talc. More specifically, the cleaning implement 164 can comprise a pad of die cut microsuede fabric. In other embodiments, other types of sweeping, dusting, or scrubbing pads can be used.

The center portion 174 can be solid, i.e. free, or substantially free of any openings or breaks. As shown in FIG. 12, a center hole 178 and two smaller holes 180 adjacent the center hole 178 can be provided in the cleaning implement 164 for attachment of the rotational body 162 to the pad. The center portion 174 of the embodiment shown is otherwise solid.

The tensioner hub 166 can extend over the center portion 174 of the cleaning implement 164. With a solid center portion 174, cleaning implement 164 extends continuously beneath the tensioner hub 166, with the tensioner hub 166 in flush engagement with the cleaning implement 164. In other embodiments, the cleaning implement 164 can extend continuously beneath the tensioner hub 166, with the tensioner hub 166 in flush engagement with the cleaning implement 164, with a non-solid center portion, i.e. with a center portion having one or more openings or breaks. In these and other embodiments, the tensioner hub 166 can be glued to the center portion 174.

Figure 10:
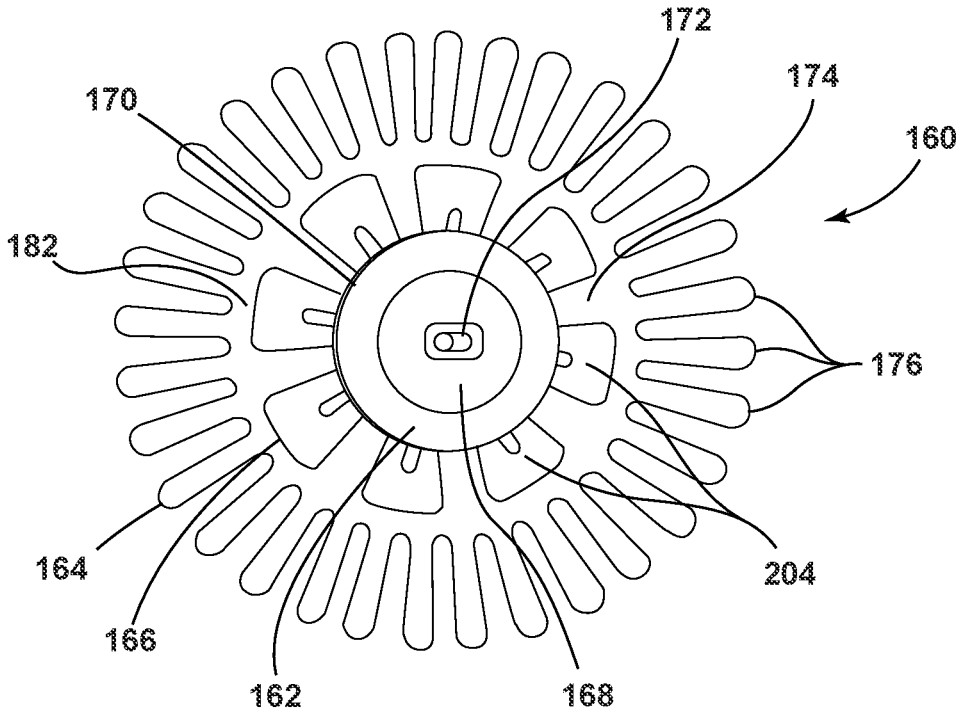
FIG. 10 is a top view of another embodiment of an edge cleaning brush.
Figure 11:
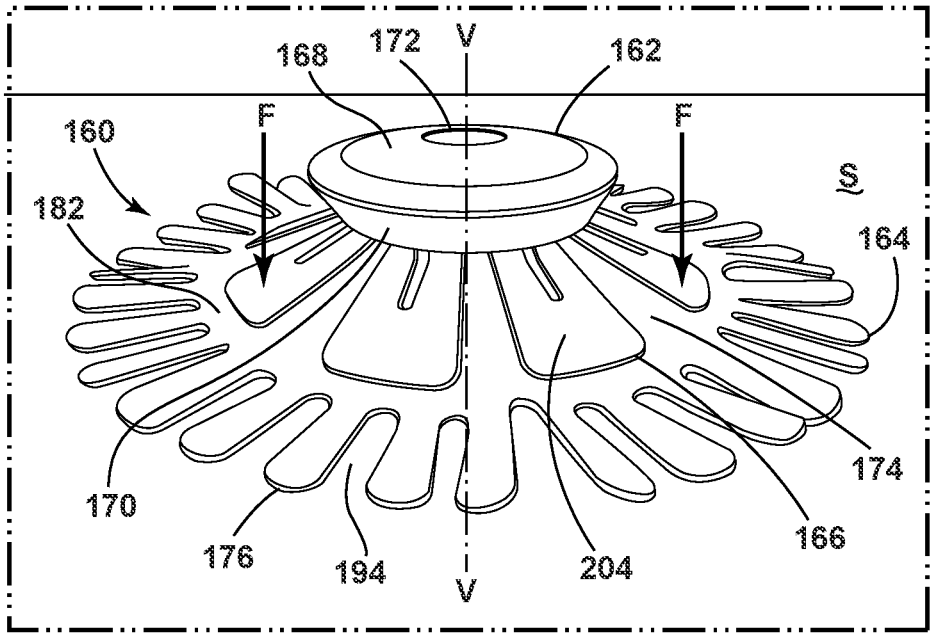
FIG. 11 is a perspective view of the edge cleaning brush from FIG. 10 on a surface to be cleaned, illustrating the tensioner hub applying downward force on the cleaning implement.

The plurality of fingers 176 can project beyond a periphery of the tensioner hub 166. As shown in FIG. 10, the center portion 174 can comprise an annular section 182 that extends beyond the periphery of the tensioner hub 166, with the fingers 176 extending from the annular section 182.

Hence, the tensioner hub 166 does not extend over the fingers 176 and instead engages the cleaning implement 164 inwardly of the fingers 176.

The fingers 176 can project radially from the center portion 174 as shown, or may be curved. Optionally, with the center portion 174 comprising the annular section 182 that is disposed radially outwardly from the tensioner hub 166, the fingers 176 can project radially from the annular section 182.

The fingers 176 can be spaced equally about the rotational axis V. For example, in the embodiment of the edge cleaning brush 160 shown, the cleaning implement 164 can comprise 32 fingers which are spaced approximately 11.25° from each other. Other numbers and spacing for the fingers are possible.

Figure 14:
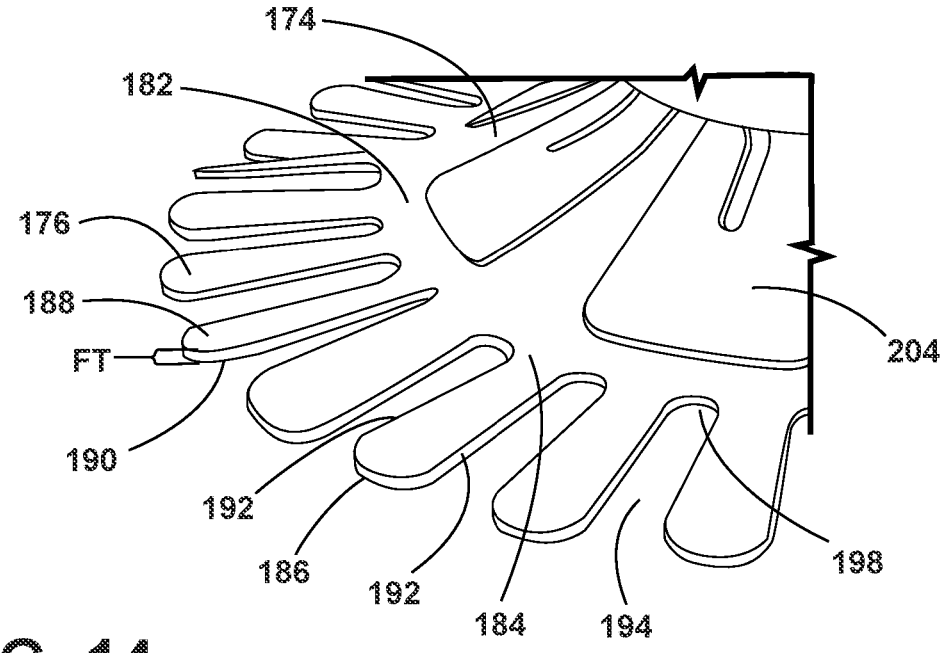
FIG. 14 is an enlarged perspective view of a portion of the edge cleaning brush from FIG. 10.
Figure 15:
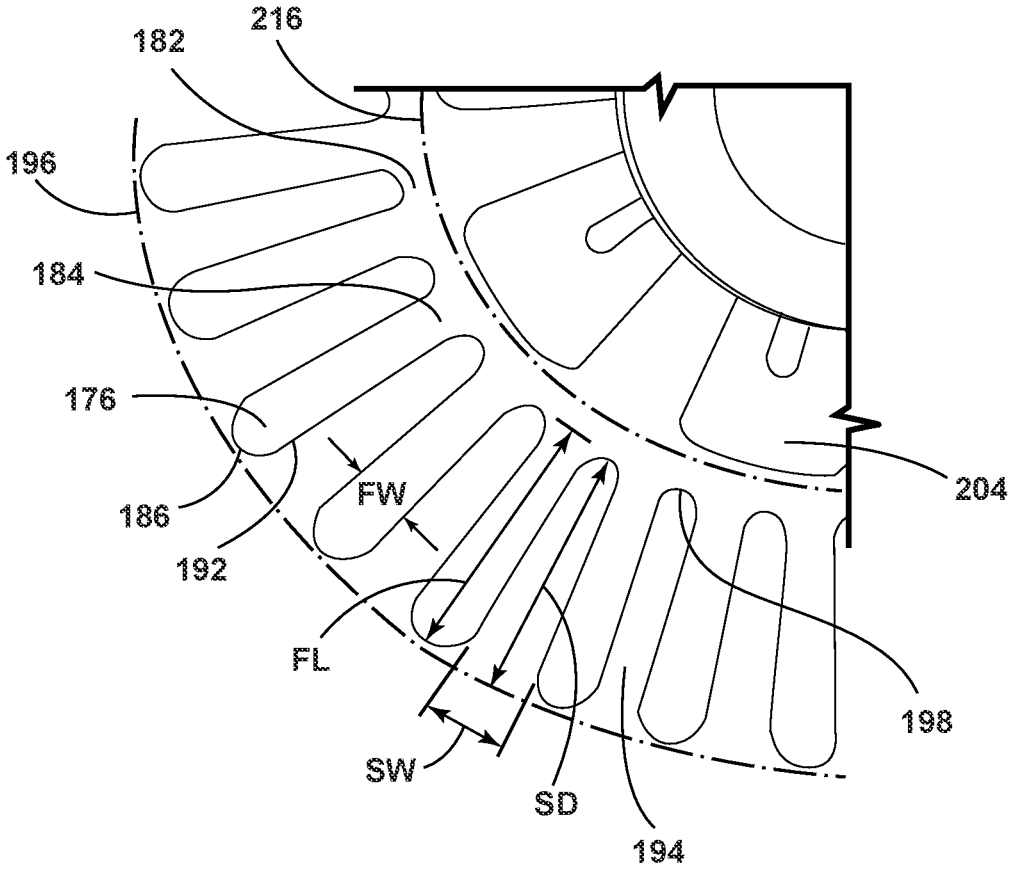
FIG. 15 is an enlarged top view of a portion of the edge cleaning brush from FIG. 10.

With reference to FIGS. 14-15, the fingers 176 can extend from a root 184 coupled with the center portion 174 to a distal or outward tip 186, and have a top side 188 and a bottom side 190. The bottom side 190 presses against the surface to be cleaned in operation. The tips 186 can collectively define the outer periphery 196 of the cleaning implement 164. Each finger 176 can have spaced side edges 192 that join the root 184 to the tip 186. The shape, size, and spacing of the fingers 176 can be uniform as shown. In yet other embodiments, the shape, size, and/or spacing of individual fingers 176 can be different.

The fingers 176 can be separated by slots 194. The slots 194 can extend radially inwardly from an outer periphery 196 of the cleaning implement 164 and define a gap between the side edges 192 of adjacent fingers 176. The slots 194 are open at the outer periphery 196 and extend to slot ends 198 disposed inwardly of the outer periphery 196.

The fingers 176 have a finger thickness FT defined as the distance between the top and bottom sides 188, 190, a finger length FL defined as the distance between the root 184 and the tip 186, and a finger width FW defined as the distance between the side edges 192. The fingers 176 can be broad, flat members, with the thickness FT being less than the length FL or width FW. The finger width FW can be constant from root 184 to tip 186, or may vary, such as increasing from root 184 to tip 186 as shown in the illustrated embodiment.

Each slot 194 has a slot width SW defined as the distance between side edges 192 of adjacent fingers 176 and a slot depth SD defined as the distance from the outer periphery 196 of the cleaning implement 164 to the end 198 of the slot 194. In one embodiment, the slot depth SD can be 10 to 20 mm, inclusive, alternatively 15 mm.

The tips 186 of the fingers 176 and the ends 198 of the slots 194 connecting adjacent fingers 176 can be rounded. Other shapes for the fingers 176 and ends of the slots 194 are possible, such as being squared off or angled.

Figure 13:
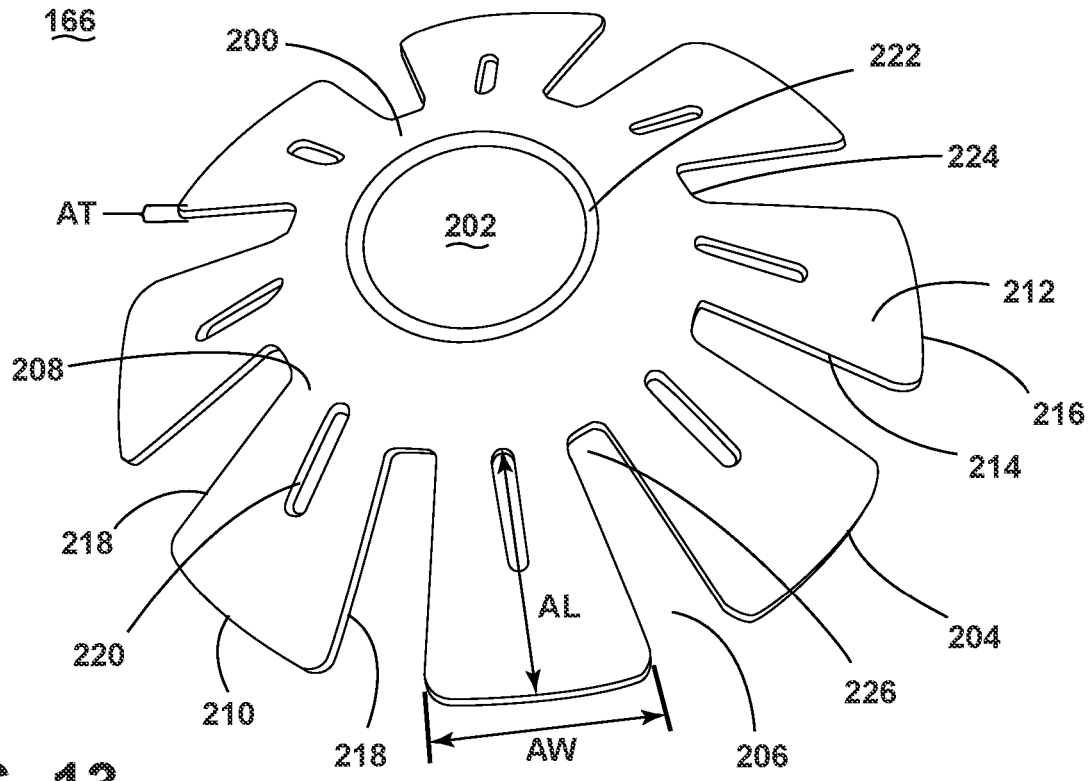
FIG. 13 is a perspective view of a tensioner hub for the edge cleaning brush from FIG. 10.

Referring to FIG. 13, the tensioner hub 166 can comprise an inner annular portion or ring 200 defining a center opening 202 and an outer portion comprising tensioner arms 204 that are separated by slots 206. The arms 204 can extend radially outwardly from the ring 200 as shown, or may extend along a curve from the ring 200. The tensioner hub 166 can be cone-shaped to pre-load the cleaning implement 164, i.e. to exert downward force onto the cleaning implement 164 to force the cleaning implement 164 against the surface to be cleaned. Other shapes for pre-loading the cleaning implement 164 are possible, such as dome-shaped tensioner hub 166.

Each arm 204 can extend from a first end or root 208 attached to the ring 200 to a second end or tip 210, and have a top side 212 and a bottom side 214. The bottom side 214 presses against the cleaning implement 164 when the tensioner hub 166 is assembled with the cleaning implement 164. The tips 210 can collectively define an outer periphery 216 of the hub 166. Each arm 204 can have spaced side edges 218 that join the root 208 to the tip 210. The side edges 218 of adjacent arms 204 are separated by one of the slots 206. The arms 204 can be substantially solid, or, as shown herein, can comprise at least one opening 220 therein, which can increase flexibility of the arms 204.

The arms 204 can be spaced equally about the rotational axis V. For example, in the embodiment of the edge cleaning brush 160 shown, the tensioner hub 166 can comprise eight arms 204 which are spaced approximately 45° from each other. Other arm numbers and spacing are possible.

The arms 204 have an arm thickness AT defined as the distance between the top and bottom sides 212, 214, an arm length AL defined as the distance between the root 208 and the tip 210, and an arm width AW defined as the distance between the side edges 218. The arms 204 can be flat members, with the thickness AT being less than the length AL or width AW.

The width AW can be constant from root 208 to tip 210, or may vary, such as increasing from root 208 to tip 210 as shown in the illustrated embodiment. As viewed from above, as in FIG. 10, the arms 204 have the overall shape of a trapezoid. Other arm shapes are possible, such as, but not limited to, square, rectangular, parallelogram, or other polygonal shapes. In yet other embodiments, the length, width, and/or thickness of individual arms 204 can be different.

For the cone-shaped tensioner hub 166 shown, the ring 200 can be frustoconical, tapering downwardly from an inner edge 222 of the ring 200, which forming a top edge of the cone-shape and defines the center opening 202, to an outer edge 224 of the ring 200, which forms a bottom edge of the cone-shape. The arms 204 extend from the outer or bottom edge 224 of the ring 200. The outer or bottom edge 224 can define a plane, and the arms 204 can be disposed below the plane, and can extend in a direction away from the plane, from root 208 to tip 210, at an angle.

Figure 23:
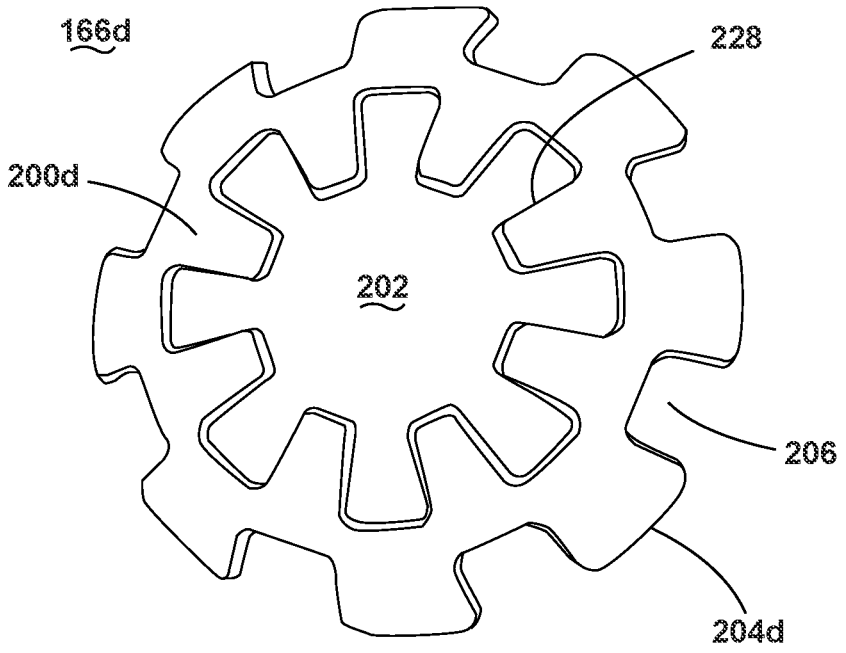
FIG. 23 is a top perspective view of a yet another embodiment of a tensioner hub for an edge cleaning brush.

In the embodiment shown, the ring 200 is positioned close to the center of the tensioner hub 166, i.e. it is within the inner half of the radius of the tensioner hub 166. In an alternative embodiment, the ring 200 can be positioned further out on the radius to increase stiffness and form holding functionality of the cleaning implement 164, such as by being within the outer half of the radius of the tensioner hub 166 or extending partially from the inner half to the outer half. FIG. 23, described in further detail below, shows an alternate embodiment of a tensioner hub **166*d* for the brush 160**.

Figure 24:
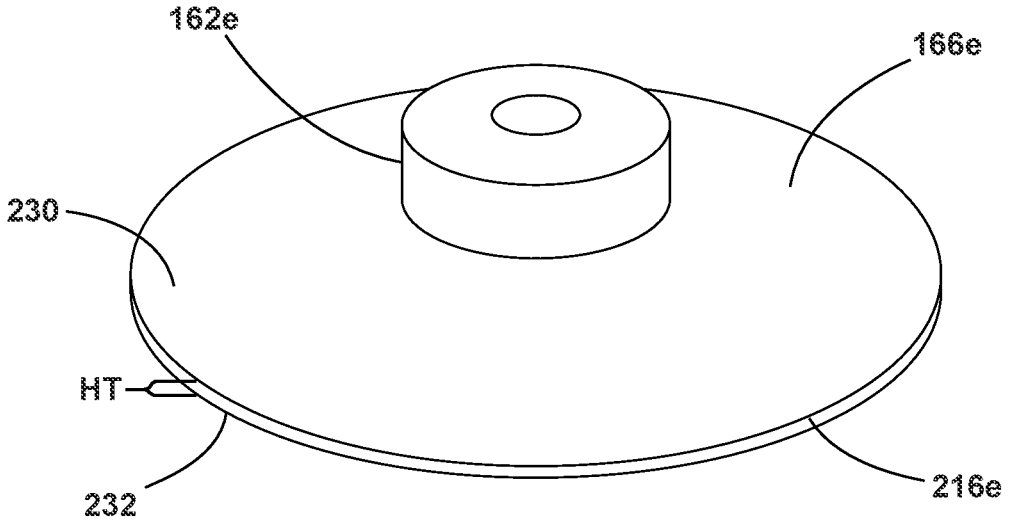
FIG. 24 is a top perspective view of a still another embodiment of a tensioner hub and rotational body for an edge cleaning brush.

The slots 206 extend from the outer periphery 216 of the hub 166, toward the center of the hub 166. The slots 206 are open at the outer periphery 216 and extend to slot ends 226 disposed inwardly of the outer periphery 216. The slots 206 allow individual flexing of the arms 204 for deflection on non-flat surfaces such as walls and floor trim. In an alternative embodiment, the hub 166 can be a solid or without fingers, and may be ring-shaped. FIG. 24, described in further detail below, shows an alternate embodiment of a solid tensioner hub **166*e* for the brush 160**.

The tips 210 of the arms 204 and the ends 226 of the slots 206 can be squared off as shown. Other shapes for the arms 204 and slots 206 are possible, such as being rounded, curved, or angled.

The tensioner hub 166 can be fabricated from an elastomeric or copolymer material, such as a resilient thermoplastic material, so that the arms 204 that are stiff enough to provide downward force on the cleaning implement 164 so that the cleaning implement 164 stays in contact with the surface S to be cleaned during rotation, without creating excessive drag between the cleaning implement 116 and the surface S during operation. One example of a resilient thermoplastic material is urethane, optionally having a Shore A durometer of 72-90, inclusive, alternatively having a Shore A durometer of 81. Another suitable material for the tensioner hub 166 is thermoplastic polyurethane (TPU) having a Shore A durometer of 70. Other elastomeric or copolymer materials are possible.

To assemble the edge cleaning brush 160, the tensioner hub 166 can be affixed to the cleaning implement 164 using a suitable attachment method, such as welding or gluing. An underside surface of the tensioner hub 166, including the bottom side 214 of the arms 204, can be affixed to the upper surface of the cleaning implement 164, so that at least the arms 204 are in full contact with the center portion 174 of the cleaning implement 164. Optionally the bottom side of the ring 200 is also affixed to the center portion 174 to increase contact between the tensioner hub 166 and the cleaning implement 164.

In one specific embodiment of the edge cleaning brush 160, the cleaning implement 164 comprises a die-cut microsuede pad, and is assembled with an elastomeric or copolymer material tensioner hub 166 using high frequency (HF) welding. This subassembly is assembled with a molded plastic attachment hub 168.

Figure 16:
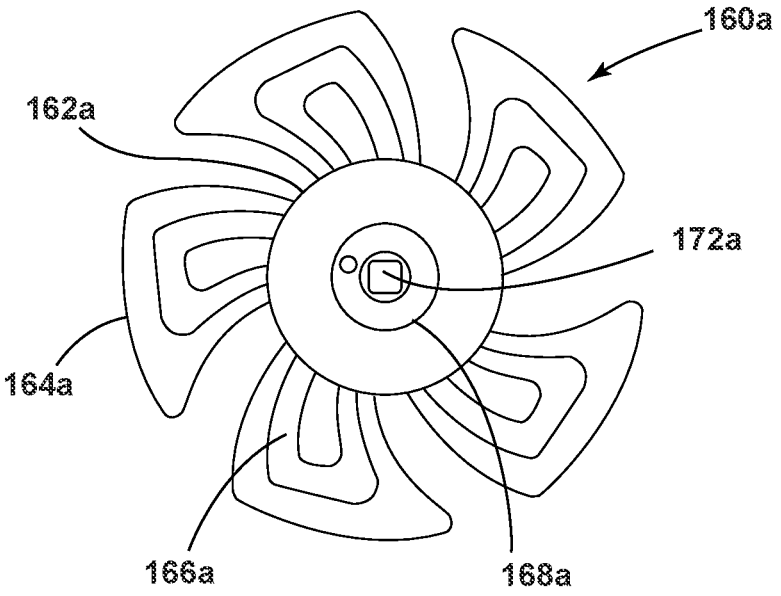
FIG. 16 is a top view of yet another embodiment of an edge cleaning brush.
Figure 17:
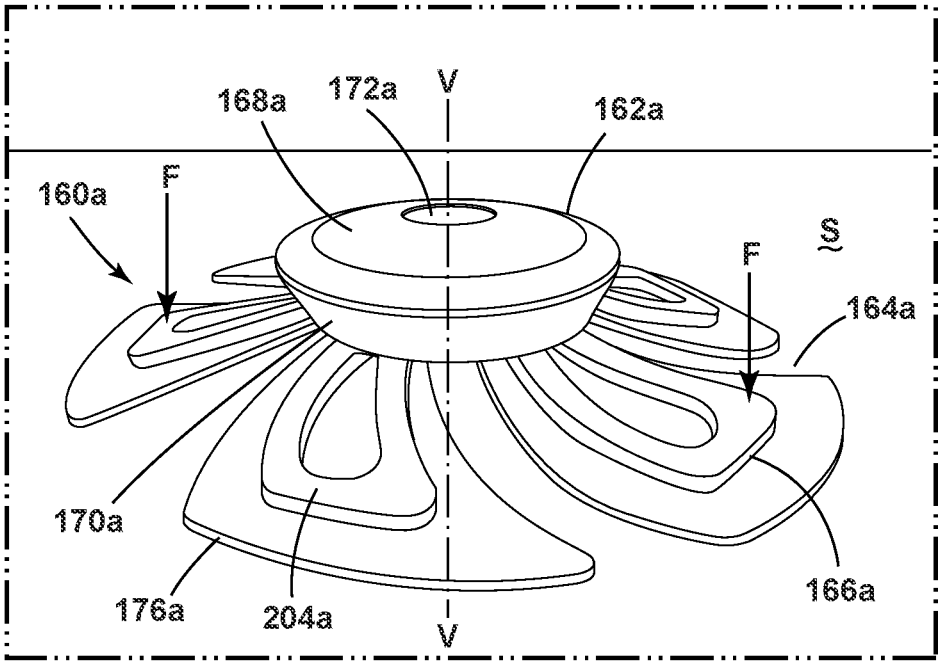
FIG. 17 is a perspective view of the edge cleaning brush from FIG. 16 on a surface to be cleaned, illustrating the tensioner hub applying downward force on the cleaning implement.
Figure 18:
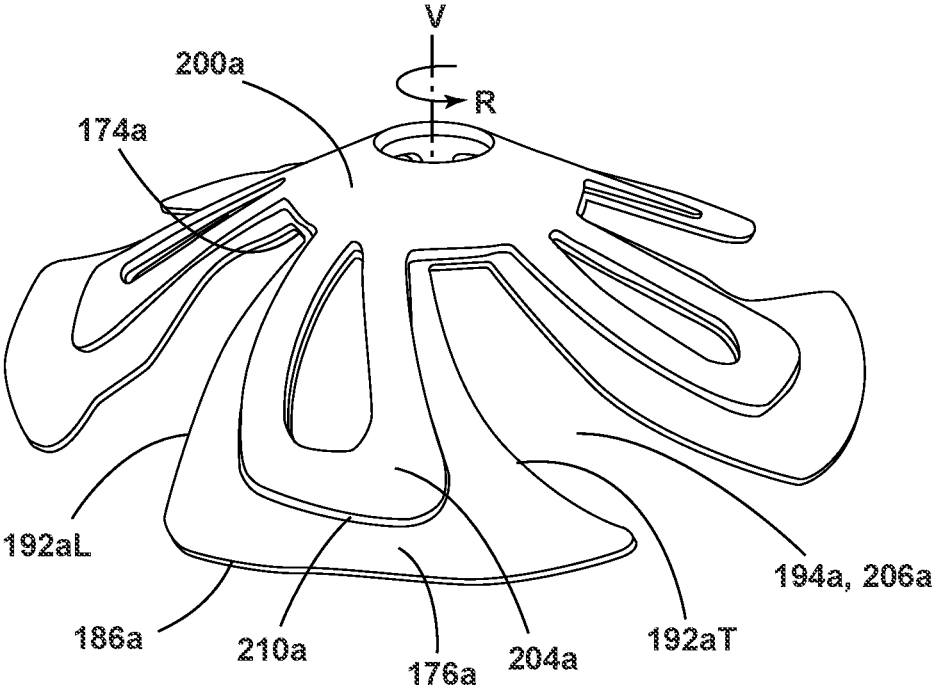
FIG. 18 is a perspective view of the edge cleaning brush from FIG. 16, with an attachment hub removed to illustrate a tensioner hub attached to a cleaning implement.

FIG. 16-18 show details of yet another embodiment of an edge cleaning brush, generally designated 160*a*. The embodiment of FIGS. 16-18 is substantially similar to the embodiment of the edge cleaning brush 160 shown in FIGS. 10-15, and like elements will be referred to with the same reference numerals bearing a letter "a." The edge cleaning brush 160*a* can be provided on the vacuum cleaner 10 shown in FIGS. 1-9 in place of one or both of the edge cleaning brushes 60L, 60R, or can be provided on another surface cleaning apparatus to clean hard-to reach spaces such as along edges and in corners of a room, including edges or corners created by walls, baseboards, cabinetry, furniture, etc. The edge cleaning brush 160*a* can be configured rotate about a substantially vertical rotational axis V.

The edge cleaning brush 160*a* can comprise a rotational body 162*a*, cleaning implement 164*a*, and tensioner hub 166*a* as previously described, with the following differences. The tensioner hub 166*a* can extend over the center portion 174*a* of the cleaning implement 164*a*, as well as over the fingers 176*a* of the cleaning implement 164*a*. The center portion 174*a* can be substantially coextensive with the ring 200*a* of the tensioner hub 166*a*.

The tensioner arms 204*a* can extend over the fingers 176*a*, with the tips 210*a* of the tensioner arms 204*a* being disposed inwardly of the tips 186*a* of the fingers 176*a* and the tips 186*a* of the fingers 176*a* projecting beyond a periphery of the tensioner hub 166*a*. The slots 194*a* separating adjacent fingers 176*a* can be aligned with the slots 206*a* separating adjacent tensioner arms 204*a*.

The fingers 176*a* can project non-radially from the center portion 174*a*. Hence, the fingers 176*a* define an acute angle and obtuse angle at their points of connection with the center portion 174*a*. In other words, the fingers 176*a* are at an angle relative to a radius taken from the rotational axis V of the brush 160*a* and are non-radially aligned. By forming the fingers 176*a* non-radially, the fingers 176*a* are longer than they would be extended radially. Thus, the extra length allows the fingers 176*a* to define a greater surface area for cleaning.

In additional to being non-radially aligned, the fingers 176*a* can be curved in the rotational direction R of the brush 160*a*. The fingers 176*a* have a curved leading side edge 192$a_L$ and a curved trailing edge 192$a_T$. The curved leading side edge 192$a_L$ can meet the tip 186*a* at an obtuse angle, and the curved trailing edge 192$a_T$ can meet the tip 186*a* at an acute angle.

The tensioner arms 204*a* can project non-radially from the ring 200*a*. Hence, the arms 204*a* define an acute angle and obtuse angle at their points of connection with the ring 200*a*. In other words, the arms 204*a* are at an angle relative to a radius taken from the rotational axis V of the brush 160*a* and are non-radially aligned. By forming the arms 204*a* non-radially, the arms 204*a* are aligned over the fingers 176*a* to press the fingers 176*a* against the surface to be cleaned. In additional to being non-radially aligned, the tensioner arms 204*a* can be curved in the rotational direction R of the brush 160*a* to match the curvature of the fingers 176*a*.

The fingers 176*a* and arms 204*a* can be spaced equally about the rotational axis V. For example, in the embodiment of the edge cleaning brush 160*a* shown, the cleaning implement 164*a* can comprise five fingers and five arms that are spaced approximately 72° from each other. Other numbers and spacing for the fingers and arms are possible.

Figure 19:
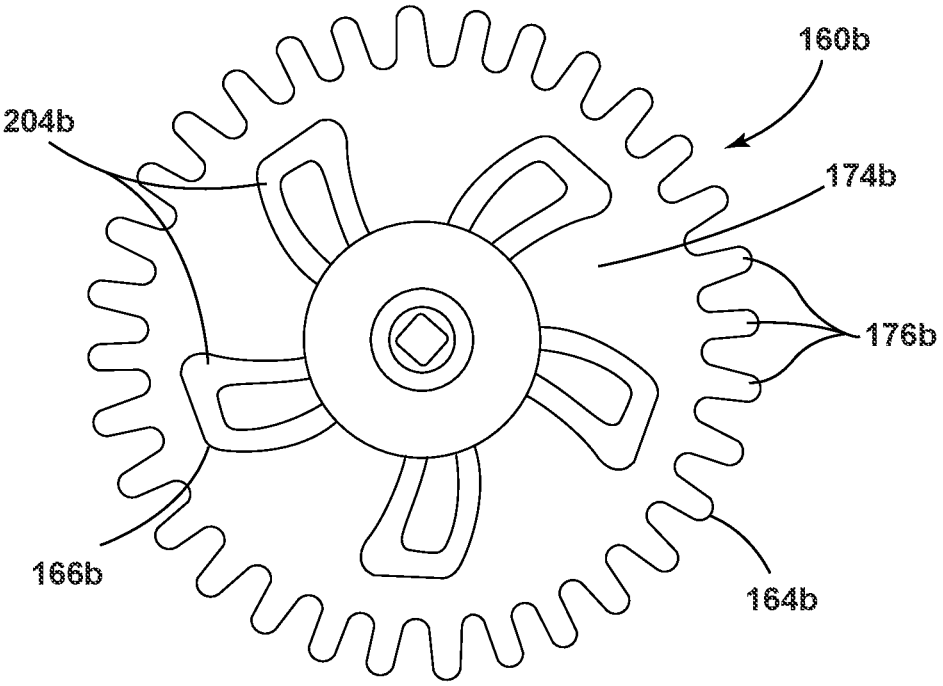
FIG. 19 is a top view of still another embodiment of an edge cleaning brush.

Various combinations of the cleaning elements and tensioner hubs are possible. For example, FIG. 19 shows still another embodiment of an edge cleaning brush, generally designated 160*b*, in which like elements will be referred to with the same reference numerals bearing a letter "b." The edge cleaning brush 160*b* can comprise a cleaning pad 164*b* with fingers 176*b* as described for the embodiment of FIGS. 10-15 and a tensioner hub 166*b* as described for the embodiment of FIGS. 16-18.

Figure 20:
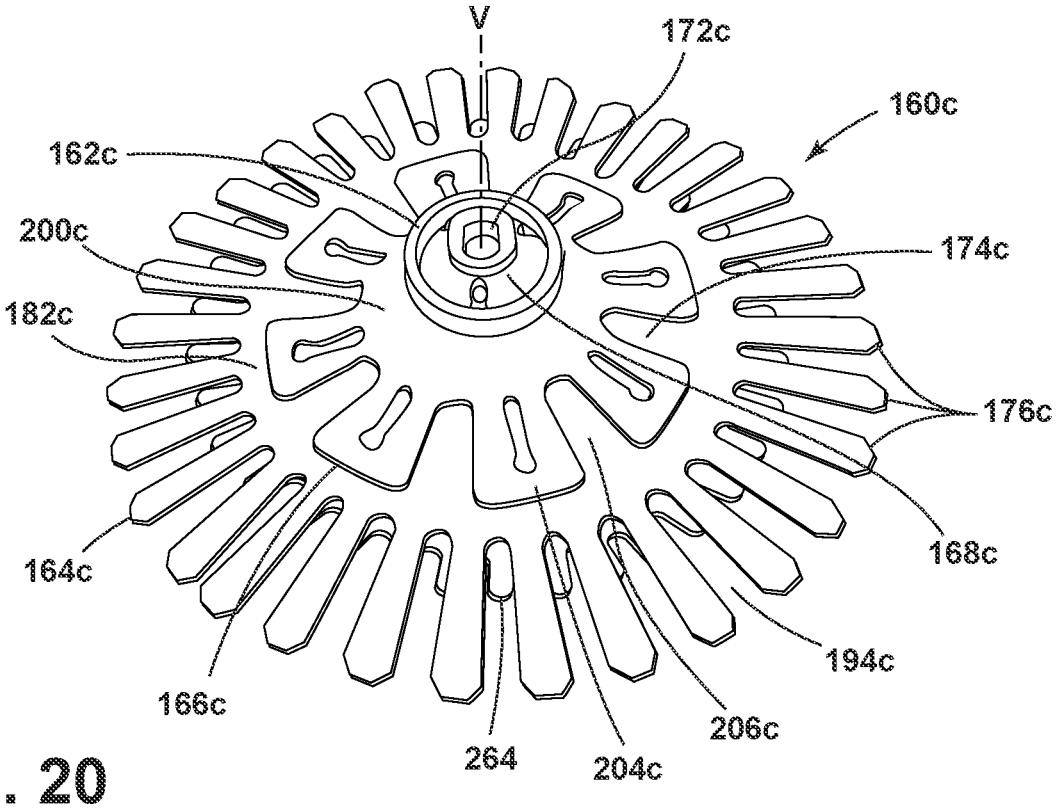
FIG. 20 is a top perspective view of a further embodiment of an edge cleaning brush.
Figure 21:
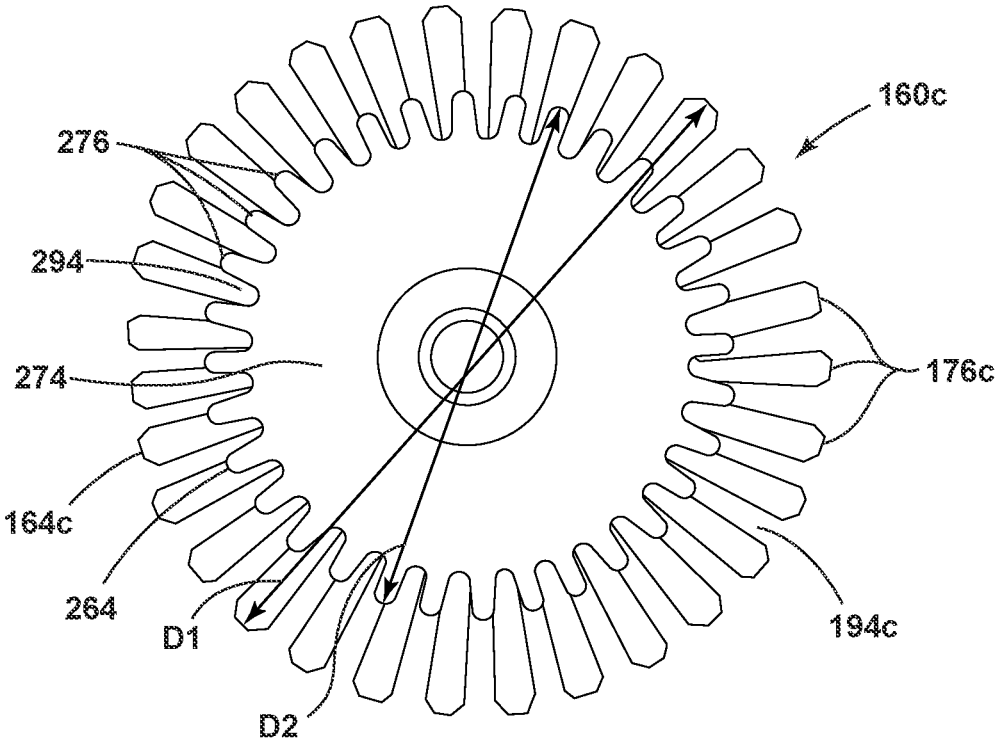
FIG. 21 is a bottom view of the edge cleaning brush from FIG. 20.
Figure 22:
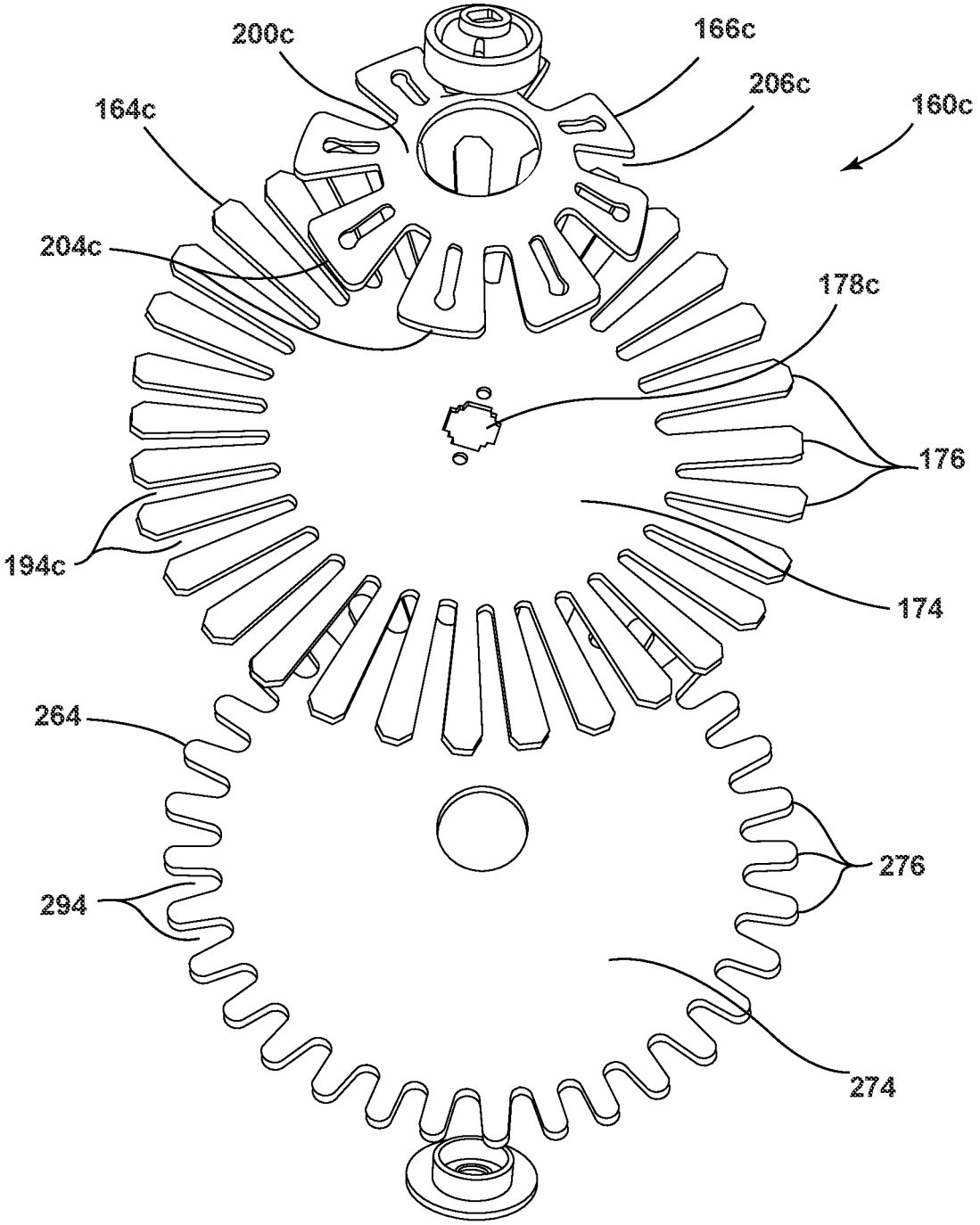
FIG. 22 is an exploded view of the edge cleaning brush from FIG. 20.

FIGS. 20-22 show details of a further embodiment of an edge cleaning brush, generally designated 160*c*, in which like elements will be referred to with the same reference numerals bearing a letter "c". The edge cleaning brush 160*c* can be provided on the vacuum cleaner 10 shown in FIGS. 1-9 in place of one or both of the edge cleaning brushes 60L, 60R, or can be provided on another surface cleaning apparatus to clean hard-to reach spaces such as along edges and in corners of a room, including edges or corners created by walls, baseboards, cabinetry, furniture, etc. The edge cleaning brush 160*c* can be configured rotate about a substantially vertical rotational axis V.

The edge cleaning brush 160*c* can comprise a rotational body 162*c*, cleaning implement 164*c*, and tensioner hub 166*c* as previously described, with the following differences. A second cleaning implement 264 is stacked underneath the first cleaning implement 164*c*. With this stacked arrangement, the first cleaning implement 164*c* can generally overlie the second cleaning implement 264. The cleaning implements 164*c*, 264 can be concentrically aligned along the rotational axis V of the edge cleaning brush 160*c*. While two cleaning implements are shown herein, in other embodiments, three or more cleaning implements can be provided and stacked with tensioner hub 166*c*.

The cleaning implements 164*c*, 264 can have different diameters. As best seen in FIG. 21, the lower cleaning implement 264 has a smaller diameter D2 than a diameter D1 of the upper cleaning implement 164*c*. Hence, the upper cleaning implement 164*c* extends beyond the lower cleaning implement 264.

The second cleaning implement 264 can be similar to the first cleaning implement 164*c*, including comprising a pad with an inner or center portion 274 and an outer portion comprising a plurality of fingers 276 that project from a periphery of the center portion 274. The fingers 276 can be separated by slots 294. The plurality of lower fingers 276 can project beyond a periphery of the tensioner hub 166*c*, and the plurality of upper fingers 176*c* can project beyond the tips of the lower fingers 276. It is understood that the description provided herein of materials, manufacturing, and assembly of the first cleaning implement 164 apply to the second cleaning implement 264, unless otherwise noted.

The cleaning implements 164*c*, 264 can rotate together in a fixed angular relationship, such as by being affixed together by the attachment hub 168*c*. Optionally, the lower fingers 276 can be aligned with the slots 194 between the upper fingers 176*c*, and the upper fingers 176*c* can be aligned with the slots 294 between the lower fingers 276. Other angular relationships are possible, including where the fingers 176*c*, 276 partially or fully overlap each other.

In operation, at least a portion of each cleaning implement 164*c*, 264 can be in contact with the floor, and may optionally contact the baseboard. Due to its smaller diameter, the lower cleaning implement 264 can maintain contact with the floor and lower portion of the baseboard, such as the quarter round, even when the upper cleaner implement 176*c* rides up the baseboard. The tensioner hub 166*c* applies downward force the cleaning implements 164*c*, 264 to force the cleaning implements 164*c*, 264 against the surface to be cleaned, including floors and baseboards as previously described. The tensioner hub 166 also provides structural support to both cleaning implements 164*c*, 264.

FIG. 23 is a top perspective view of a yet another embodiment of a tensioner hub 166*d* in which like elements will be referred to with the same reference numerals bearing a letter "d." The tensioner hub 166*d* can be used on an edge cleaning brush, such as the edge cleaning brush 160 described for the embodiment of FIGS. 10-15. The ring 200*d* can be positioned further out on the radius of the tensioner hub 166*d* to increase stiffness and form holding functionality of the cleaning implement (not shown), such as by being within the outer half of the radius of the tensioner hub 166*d*. In addition to having tensioner arms 204*d* extending outwardly from the ring 200*d*, the tensioner hub 166*d* can have stiffening arms 228 extending inwardly from the ring 200*d* to further aid in increasing stiffness and form holding.

FIG. 24 is a top perspective view of a still another embodiment of a tensioner hub 166*e* in which like elements will be referred to with the same reference numerals bearing a letter "e." The tensioner hub 166*e* can be used on an edge cleaning brush, such as the edge cleaning brush 160 described for the embodiment of FIGS. 10-15. The tensioner hub 166*e* is a solid disc, and does not include any arms. The tensioner hub 166*e* can be cone-shaped to pre-load the cleaning implement (not shown), i.e. to exert downward force onto the cleaning implement to force the cleaning implement against the surface to be cleaned. Other shapes for pre-loading the cleaning implement are possible, such as dome-shaped tensioner hub 166*e*.

The tensioner hub 166*e* can optionally include a center opening for attachment with the rotational body 162*e* and/or a cleaning implement (not shown), and may therefore be ring-shaped. With a cone-shaped tensioner hub 166*e* having a center opening, the overall shape of the tensioner hub 166*e* can be frustoconical.

The tensioner hub 166*e* has a thickness HT defined as the distance between top and bottom sides of the hub 166*e*. The thickness HT can be constant across the hub 166*e* or the thickness HT may vary. In one embodiment, the thickness HT increasing radially, i.e. increasing from the center of the hub to the outer periphery 216*e* such that the hub 166*e* is thickest at the outer periphery 216*e*.

Optionally, the tensioner hub 166*e* can be integrally formed with the rotational body 162*e* to form a subassembly, and then subsequently affixed to a cleaning implement (not shown), such as by adhesive bonding, heat-staking, or overmolding, for example. The tensioner hub 166*e* and rotational body 162*e* can be integrally formed via injection molding, additive manufacturing, or another suitable process.

While shown herein on an upright floor cleaner, the various embodiments of edge cleaning brushes disclosed herein can be provided on surface cleaning apparatus with similar functional systems arranged in other configurations, such as an autonomous or robotic device having an autonomously moveable housing with one or more edge cleaning brushes, a canister device having a cleaning tool with one or more edge cleaning brushes connected to a wheeled base by a vacuum hose, a portable device adapted to be hand carried by a user for cleaning relatively small areas, or a commercial device. Any of the aforementioned cleaners can be adapted as multi-floor cleaning apparatus that can be used to clean hard floor surfaces such as tile and hardwood and soft floor surfaces such as carpet, and can perform both dry and wet cleaning. Aspects of the disclosure may also be incorporated into a steam apparatus, such as surface cleaning apparatus with steam delivery. Aspects of the disclosure may also be incorporated into an apparatus with only recovery or dry vacuuming capabilities, such as surface cleaning apparatus without fluid delivery.

To the extent not already described, the different features and structures of the various embodiments of the invention, may be used in combination with each other as desired, or may be used separately. That one surface cleaner or surface cleaning apparatus is illustrated herein as having all of these features does not mean that all of these features must be used in combination, but rather done so here for brevity of description. Thus, the various features of the different embodiments may be mixed and matched in various cleaning apparatus configurations as desired to form new embodiments, whether or not the new embodiments are expressly described.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular components or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

What is claimed is:

1. A surface cleaning apparatus, comprising:

a housing adapted to move across a surface to be cleaned;

a brush motor;

a brushroll rotatable about a brushroll axis, wherein the brushroll is operably coupled to and driven by the brush motor; and a modular unit removably coupled to the housing, the modular unit comprising:

an edge brush comprising an attachment hub rotatable about a rotational axis and a cleaning implement configured to contact the surface to be cleaned; and an edge brush drive coupling to operably couple the edge brush with the brushroll, the edge brush drive coupling comprising:

a gear train operably coupleable with the brushroll, wherein the gear train comprises:

a worm operably coupleable with the brushroll for rotation therewith, wherein the rotational axis of the attachment hub is disposed in front of the worm and forwardly of the brushroll axis; and a two-stage gear having a first gear enmeshed with the worm and a second gear coupled with the first gear for rotation therewith, wherein the two-stage gear is disposed behind the worm and rearwardly of the brushroll axis;

a gear casing housing the gear train;

a driven gear coupled with the attachment hub and rotatable about the rotational axis; and an edge brush belt directly coupling the second gear with the driven gear to transmit the rotational force of the two-stage gear to the edge brush.

2. The surface cleaning apparatus of claim 1 comprising a brushroll drive coupling between the brushroll and the brush motor, the brushroll drive coupling comprising:

a driven wheel on the brushroll that transmits rotational force provided by the brush motor to the brushroll;

wherein the gear train is coupleable with the driven wheel.

3. The surface cleaning apparatus of claim 2 wherein the brushroll drive coupling comprises a drive belt frictionally engaging the driven wheel on the brushroll and a drive wheel coupled with an output of the brush motor.

4. The surface cleaning apparatus of claim 2 wherein the gear train comprises a splined driven member, and the driven wheel comprises a splined drive member configured to mate axially with the splined driven member.

5. The surface cleaning apparatus of claim 1 wherein the edge brush comprises a drive shaft extending upwardly from the attachment hub and the driven gear is coupled to the drive shaft.

6. The surface cleaning apparatus of claim 1 wherein the edge brush comprises a drive shaft defining the rotational axis of the edge brush and the gear casing comprises an aperture through which the drive shaft extends to connect the edge brush with the drive coupling.

7. The surface cleaning apparatus of claim 1 wherein the gear train is configured to reduce a rotational speed of the edge brush relative to the brushroll, such that the edge brush rotates at a slower speed than the brushroll.

8. The surface cleaning apparatus of claim 1 wherein the gear casing is removably coupled to the housing to attach the modular unit to the housing.

9. The surface cleaning apparatus of claim 1, wherein the rotational axis of the edge brush is substantially perpendicular to the brushroll axis.

10. The surface cleaning apparatus of claim 1 comprising a vacuum collection system comprising a working air path through the housing, a suction nozzle defining a dirty inlet to the working air path, a suction source in fluid communication with the suction nozzle, and a debris collector, wherein the suction nozzle confronts the surface to be cleaned and the edge brush is disposed at one end of the suction nozzle on an underside of the housing.

11. The surface cleaning apparatus of claim 10 comprising an upright body and a cleaning base pivotally coupled with the upright body, the cleaning base comprising the housing and the suction nozzle.

12. A surface cleaning apparatus, comprising:

a housing adapted to move across a surface to be cleaned;

a brush motor;

a brushroll rotatable about a brushroll axis, wherein the brushroll is operably coupled to and driven by the brush motor; and an edge brush mounted on the housing, wherein the edge brush is operably coupled to and driven the brush motor, the edge brush comprising:

an attachment hub rotatable about a rotational axis that is substantially perpendicular to the brushroll axis; and a cleaning implement configured to contact the surface to be cleaned; and a drive coupling between the attachment hub and the brushroll comprising:

a worm operably coupled with the brushroll for rotation therewith, wherein the rotational axis of the attachment hub is disposed in front of the worm and forwardly of the brushroll axis;

a two-stage gear having a first gear enmeshed with the worm and a second gear coupled with the first gear for rotation therewith, wherein the two-stage gear is disposed behind the worm and rearwardly of the brushroll axis; and a belt coupled with the second gear to transmit the rotational force of the two-stage gear, from behind the worm, to the attachment hub of the edge brush, in front of the worm.

13. The surface cleaning apparatus of claim 12 wherein the drive coupling between the attachment hub and the brushroll comprises a modular unit, the modular unit comprising a gear casing attached to the housing.

14. The surface cleaning apparatus of claim 12 wherein the drive coupling comprises a third gear coupled with the attachment hub to drive the attachment hub about the rotational axis, the third gear rotatable about the rotational axis, the belt directly coupling the second gear with the third gear.

15. The surface cleaning apparatus of claim 12 wherein the brushroll comprises opposing first and second ends and a driven wheel at the first end that transmits rotational force provided by the brush motor to the brushroll, wherein the worm is disposed at the first end of the brushroll and coupleable with the driven wheel.

16. The surface cleaning apparatus of claim 15 wherein the drive coupling is configured to reduce a rotational speed of the edge brush relative to the brushroll, such that the edge brush rotates at a slower speed than the brushroll.

17. The surface cleaning apparatus of claim 12 comprising a vacuum collection system comprising a working air path through the housing, a suction nozzle defining a dirty inlet to the working air path, a suction source in fluid communication with the suction nozzle, and a debris collector, wherein the suction nozzle confronts the surface to be cleaned and the edge brush is disposed at one end of the suction nozzle on an underside of the housing.

* * * * *